US007506722B2

(12) United States Patent
Emler

(10) Patent No.: US 7,506,722 B2
(45) Date of Patent: Mar. 24, 2009

(54) VEHICLE EXHAUST SYSTEMS

(76) Inventor: Don R. Emler, 18033 S. Santa Fe Ave., Rancho Dominguez, CA (US) 90221

( * ) Notice: Subject to any disclaimer, the term of this patent is extended or adjusted under 35 U.S.C. 154(b) by 0 days.

(21) Appl. No.: 11/855,462

(22) Filed: Sep. 14, 2007

(65) Prior Publication Data

US 2008/0053748 A1 Mar. 6, 2008

Related U.S. Application Data

(62) Division of application No. 11/044,680, filed on Jan. 26, 2005.

(60) Provisional application No. 60/607,445, filed on Sep. 3, 2004, provisional application No. 60/539,826, filed on Jan. 27, 2004.

(51) Int. Cl.
*F01N 1/02* (2006.01)

(52) U.S. Cl. ..... 181/249; 181/212; 181/251

(58) Field of Classification Search ..... 181/249
See application file for complete search history.

(56) References Cited

U.S. PATENT DOCUMENTS

| | | | | | |
|---|---|---|---|---|---|
| 1,909,394 | A * | 5/1933 | Dodge | 181/249 |
| 2,940,538 | A * | 6/1960 | Billey | 181/249 |
| 3,141,520 | A * | 7/1964 | Kurtze | 181/247 |
| 3,233,698 | A * | 2/1966 | Powers | 181/227 |
| 3,263,772 | A * | 8/1966 | Irwin et al. | 181/227 |
| 3,317,001 | A * | 5/1967 | Powers et al. | 181/232 |
| 3,434,280 | A * | 3/1969 | Burkhart | 60/314 |
| 3,500,954 | A * | 3/1970 | Willette | 181/232 |
| 3,561,562 | A * | 2/1971 | Ignoffo | 181/247 |
| 4,368,799 | A * | 1/1983 | Wagner | 181/255 |
| 4,690,245 | A * | 9/1987 | Gregorich et al. | 181/272 |
| 4,705,138 | A * | 11/1987 | Reese | 181/212 |
| 4,880,078 | A * | 11/1989 | Inoue et al. | 181/232 |
| 4,993,513 | A * | 2/1991 | Inoue et al. | 181/282 |
| 5,493,080 | A * | 2/1996 | Moss | 181/232 |
| 5,633,482 | A * | 5/1997 | Erion et al. | 181/282 |
| 5,962,822 | A * | 10/1999 | May | 181/264 |
| 6,164,066 | A * | 12/2000 | Sakaguchi et al. | 60/302 |
| 6,336,471 | B1 * | 1/2002 | Feuling | 138/39 |
| 6,695,094 | B2 * | 2/2004 | Moffat et al. | 181/249 |
| 6,913,112 | B2 * | 7/2005 | Bogard | 181/252 |
| 7,331,422 | B2 * | 2/2008 | Wall | 181/279 |
| 2002/0036114 | A1 * | 3/2002 | Tobias | 181/241 |
| 2002/0104707 | A1 * | 8/2002 | Moffat et al. | 181/249 |
| 2004/0094360 | A1 * | 5/2004 | Toyoshima | 181/249 |
| 2004/0261404 | A1 * | 12/2004 | Vignassa et al. | 60/324 |
| 2005/0067217 | A1 * | 3/2005 | Hansen | 181/227 |
| 2005/0126850 | A1 * | 6/2005 | Yamaguchi et al. | 181/249 |

(Continued)

FOREIGN PATENT DOCUMENTS

| | | | |
|---|---|---|---|
| JP | 53147142 | A * | 12/1978 |

(Continued)

*Primary Examiner*—Walter Benson
*Assistant Examiner*—Forrest M Phillips
(74) *Attorney, Agent, or Firm*—Shook, Hardy & Bacon LLP

(57) ABSTRACT

A vehicle exhaust assembly for improved evacuation of exhaust gases from an internal combustion engine. The system comprises a modular replacement exhaust system having a novel header pipe and muffler. The present invention readily adapts to a range of vehicle applications including automobiles, motorcycles, and all terrain vehicles.

12 Claims, 13 Drawing Sheets

U.S. PATENT DOCUMENTS

| | | | | |
|---|---|---|---|---|
| 2005/0161283 | A1* | 7/2005 | Emler | 181/249 |
| 2005/0252714 | A1* | 11/2005 | Goda et al. | 181/252 |
| 2005/0279568 | A1* | 12/2005 | Seyler et al. | 181/249 |
| 2006/0090956 | A1* | 5/2006 | Peshkovskiy et al. | 181/249 |
| 2007/0289809 | A1* | 12/2007 | Kim | 181/227 |
| 2008/0053748 | A1* | 3/2008 | Emler | 181/212 |

FOREIGN PATENT DOCUMENTS

| | | | | |
|---|---|---|---|---|
| JP | 54008233 | A | * | 1/1979 |
| JP | 56069414 | A | * | 6/1981 |
| JP | 57113919 | A | * | 7/1982 |
| JP | 58015708 | A | * | 1/1983 |
| JP | 60030463 | A | * | 2/1985 |
| JP | 62191611 | A | * | 8/1987 |

* cited by examiner

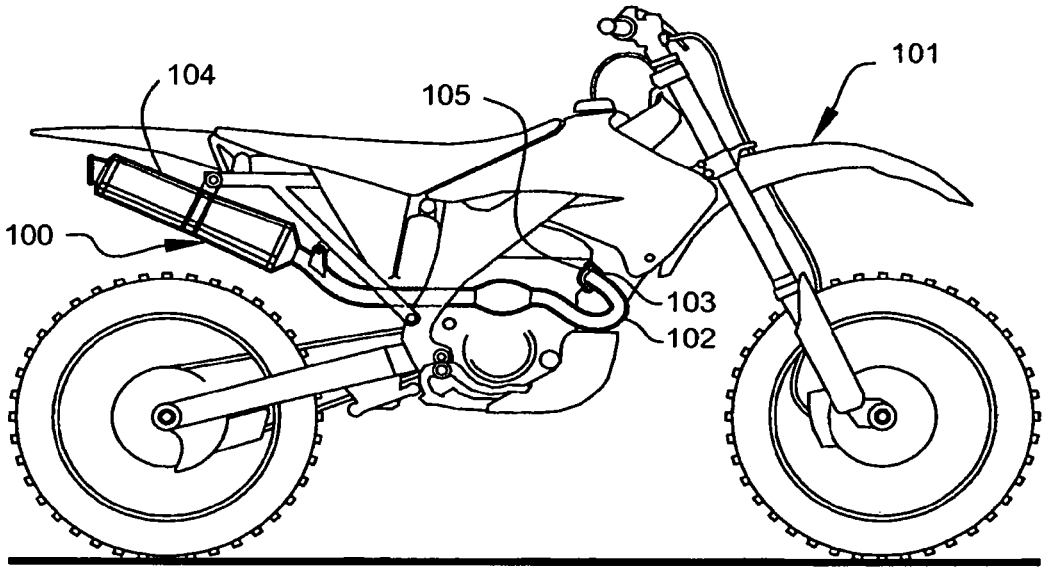
FIG. 1
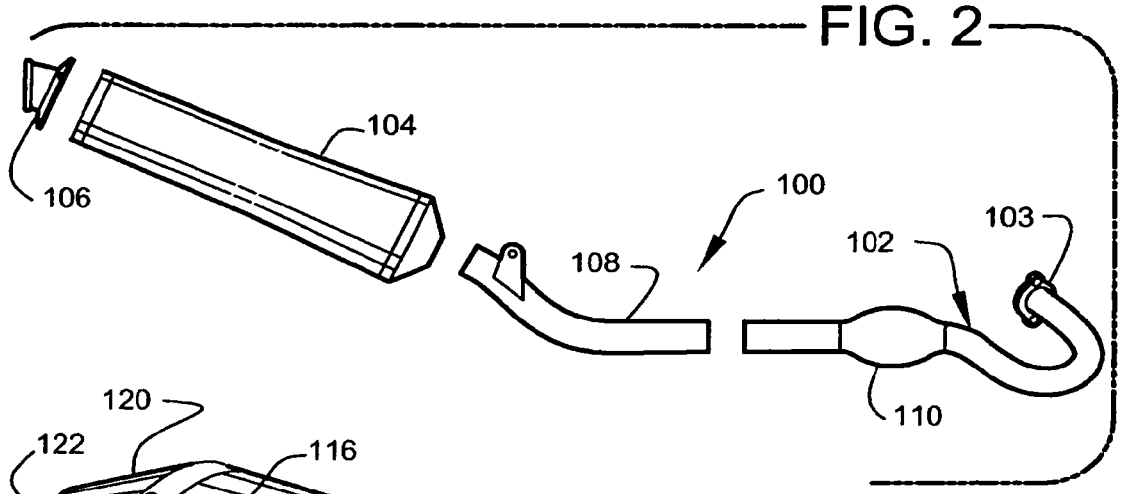
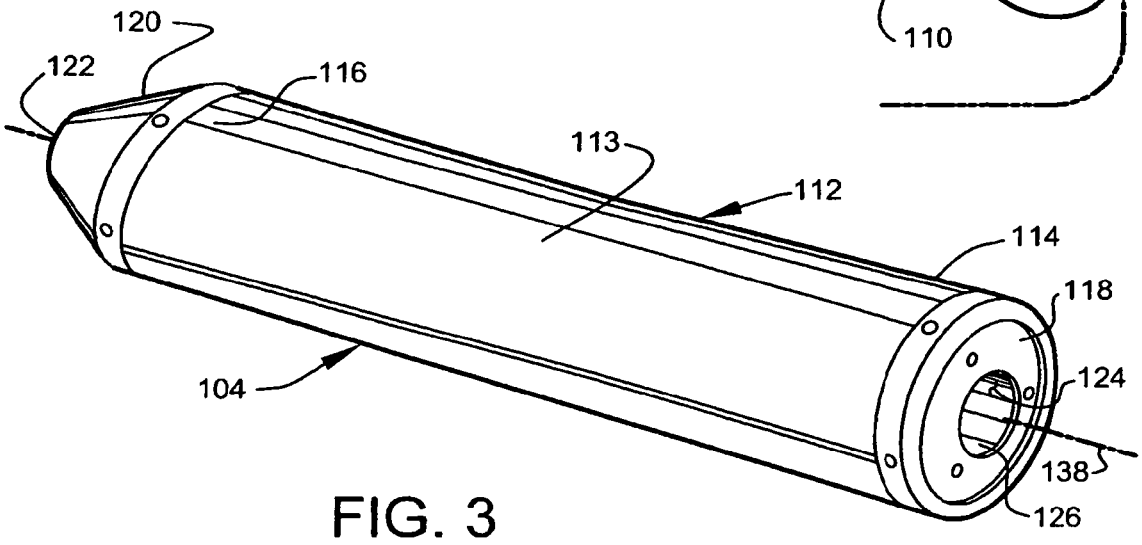
FIG. 3

VEHICLE EXHAUST SYSTEMS

CROSS-REFERENCE TO RELATED APPLICATION

The present application is a divisional application claiming priority to U.S. application Ser. No. 11/044,680, entitled "VEHICLE EXHAUST SYSTEMS", filed Jan. 26, 2005, which claims priority from prior provisional application Ser. No. 60/539,826, filed Jan. 27, 2004, entitled "VEHICLE EXHAUST SYSTEM", and prior provisional application Ser. No. 60/607,445, filed Sep. 3, 2004, entitled "VEHICLE EXHAUST SYSTEM", the contents of all of which are incorporated herein by this reference and are not admitted to be prior art with respect to the present invention by the mention in this cross-reference section.

BACKGROUND

This invention relates to providing a system for improved exhaust evacuation from an internal combustion engine.

Internal combustion engines serve to power a majority of the powered vehicles worldwide. Typically, internal-combustion-driven vehicles comprise at least one system for transporting the exhaust gases from the combustion cylinder to at least one remote discharge point adjacent the vehicle. Commonly, the exhaust system will comprise a length of metallic pipe or similar fluid-transporting conduit. In most vehicles, the exhaust system will further include at least one sound-modifying device such as a muffler or silencer.

Typical "performance" mufflers, such as found on an off-road or road-going motorcycle, are mounted high and rearward on the vehicle. Preferably, a muffler should be located as close as possible to the center of vehicle mass (forward and downward). This preferred position improves vehicle handling by lessening the dynamic loads imposed on suspension systems by reducing the outer rotating mass of the vehicle.

In general, clearance for a muffler changes from front to rear based on a vehicle's amalgamation of fixed structures. On a motorcycle, the available room at the front of the muffler is dictated by the clearance between the rear tire, rear shock, sub-frame, brake components, and inside clearance beneath the side panels or number plate. Tire contact with a muffler will cause the muffler to move, thus weakening and eventually breaking the muffler mounts. Any contact with the vehicle frame, sub-frame, or shock will eventually cause a hole to develop at the point of wear. The side panels of most motorcycles are generally made from plastic; any contact with the muffler results in heat damage. Preferably, a muffler needs to have enough sound-absorbing media to attenuate combustion noise but not so little that the sound-absorbing media would need to be serviced too frequently. On a street or road bike, the clearance needs to be such as to allow for maximum lean angle while not making contact with the road surface causing damage to the muffler and loss of stability. A need exists for an improved muffler design that both increases the clearances between the vehicle, the muffler and the driving surface, and lessens dynamic loads imposed on suspension systems by reducing the outer rotating mass of the vehicle.

It is generally known that the performance of an internal combustion engine is affected by the fluid flow characteristics of the exhaust system. Generally, the less restrictive the system is to the passage of the exhaust gasses, the greater the performance of the engine.

Internal combustion engines operate by drawing power from a controlled explosion within a combustion cylinder. In a typical four-stroke combustion cycle, an intake mixture of air and fuel is drawn into the combustion cylinder, compressed, ignited to produce power, and finally discharged from the engine to the exhaust system. Generally, the amount of performance derived from the engine is directly related to the volume of air/fuel mixture that can be introduced into the combustion cylinder during each cycle. Restrictions in the exhaust system can prevent full evacuation of the combustion gases from the cylinder, resulting in an inability of the engine to fully recharge the cylinder with a subsequent volume of fuel/air mixture. Therefore, deriving maximum power from any engine requires an exhaust system designed with the free-flow of exhaust gases as a primary objective. Unfortunately, exhaust systems often sacrifice flow in favor of other factors, for example, the reduction of sound emissions during operation.

Those who operate high performance vehicles are especially concerned with exhaust performance. Traditional methods of increasing performance of engines include increasing cylinder compression, valve modifications, and aggressive cam profiles. Each method has distinct disadvantages from the standpoint of heat generation, reliability, and engine longevity. Alternately, increasing the performance of the exhaust system may increase engine power output with relatively minor reductions in reliability.

A common practice used to meet closed course sound regulations in competitive motorcycle racing, is to use a very small diameter muffler core and an even smaller diameter outlet. The negative consequences of this arrangements is that low and mid RPM torque diminishes when compared to the performance characteristics of a large core, large outlet system.

A need exists for an exhaust system to overcome this problem while fully complying with the requirements of the American Motorcyclist Association (AMA) and Federation Internationale de Motorcyclisme (FIM) closed course sound regulations.

Furthermore, due to increasing pressure from controlling bodies to set decibel sound limits for motorized vehicles operating within public lands, a need exists for a high-performance exhaust system that provides necessary reductions in sound emissions, while maintaining a high degree of performance.

SUMMARY

A primary object and feature of the present invention is to provide a system to overcome the above-mentioned problems.

It is a further object and feature of the present invention to provide such a system that comprises a complete high-performance exhaust system for an internal combustion engine powered vehicle.

It is an additional object and feature of the present invention to provide such a system that adapts to a range of vehicle applications.

It is a further object and feature of the present invention to provide such a system that increases ground clearance in road-operated motorcycles.

It is a further object and feature of the present invention to provide such a system that increases ground clearance in off-road operated motorcycles.

It is a further object and feature of the present invention to provide such a system that improves weight distribution within a vehicle.

It is a further object and feature of the present invention to provide such a system that reduces exhaust system weight.

It is another object and feature of the present invention to provide such a system that comprises a reduced length muffler tip.

It is an additional object and feature of the present invention to provide such a system that assists user system identification by means of a color-coded muffler tip.

It is yet another object and feature of the present invention to provide such a system that comprises modular components.

It is a further object and feature of the present invention to provide such a system that reduces backpressure within the exhaust system of an internal combustion engine.

It is an additional object and feature of the present invention to provide such a system that comprises a pre-muffler in combination with a primary muffler.

It is a further object and feature of the present invention to provide such a system that reduces backpressure within the exhaust system of an internal combustion engine using a uniquely shaped core.

It is a further object and feature of the present invention to provide such a system that modifies the exhaust sound emissions while reducing backpressure within the exhaust system of an internal combustion engine by maximizing the cross-sectional area and interior surface area of the system muffler core.

A further primary object and feature of the present invention is to provide such a system that is efficient, inexpensive, and handy. Other objects and features of this invention will become apparent with reference to the following descriptions.

In accordance with a preferred embodiment hereof, this invention provides a vehicular exhaust system related to the transport of at least one moving exhaust gas, such system comprising: at least one exhaust gas inlet to admit the at least one moving exhaust gas; at least one exhaust gas outlet to discharge the at least one moving exhaust gas; at least one exhaust gas transfer conduit adapted to transfer the at least one moving exhaust gas from such at least one exhaust gas inlet to such at least one exhaust gas outlet; and at least one outer housing adapted to essentially house such at least one exhaust gas transfer conduit; wherein such at least one outer housing comprises at least one outer periphery comprising at least one outer peripheral shape; wherein such at least one exhaust gas transfer conduit permits at least one unrestricted passage of at least one portion of the at least one moving exhaust gas from such at least one exhaust gas inlet to such at least one exhaust gas outlet along a linear axis of flow; and wherein substantially each of such outer peripheral shapes of transverse sections taken at different points along such linear axis of flow is different from each other such outer peripheral shape taken at another transverse section.

Moreover, it provides such a vehicular exhaust system wherein at least one of such outer peripheral shapes comprises an oval. Additionally, it provides such a vehicular exhaust system wherein at least two of such outer peripheral shapes comprise ovals. Also, it provides such a vehicular exhaust system wherein all of such outer peripheral shapes comprise ovals. In addition, it provides such a vehicular exhaust system wherein at least one of such outer peripheral shapes comprises a circle. And, it provides such a vehicular exhaust system wherein: such at least one outer periphery progresses smoothly from an oval outer peripheral shape to a round outer peripheral shape; and such smooth progression from such oval outer peripheral shape to such round outer peripheral shape is directed from such at least one exhaust gas inlet to such at least one exhaust gas outlet. Further, it provides such a vehicular exhaust system wherein such at least one exhaust gas transfer conduit comprises at least one energy dissipater adapted to dissipate energy from the at least one pressure wave while the at least one moving exhaust gas is transferred by such at least one exhaust gas transfer conduit. Even further, it provides such a vehicular exhaust system wherein such at least one exhaust gas transfer conduit comprises at least one square cross-section. Moreover, it provides such a vehicular exhaust system wherein such at least one exhaust gas transfer conduit comprises at least one circular cross-section. Additionally, it provides such a vehicular exhaust system wherein: at least one first portion of such at least one exhaust gas transfer conduit, adjacent such at least one exhaust gas inlet, comprises at least one first cross-sectional area no more than substantially equal to such at least one inlet cross-sectional area of such at least one exhaust gas inlet; at least one second portion of such at least one exhaust gas transfer conduit, adjacent such at least one first portion, steps up to at least one second cross-sectional area substantially larger than such at least one inlet cross-sectional area; and such at least one exhaust gas transfer conduit comprises at least one exhaust gas flow-accelerating portion. Also, it provides such a vehicular exhaust system adapted to use with motorcycles. In addition, it provides such a vehicular exhaust system adapted to use with all-terrain vehicles. And, it provides such a vehicular exhaust system adapted to use with automobiles. Further, it provides such a vehicular exhaust system adapted to use with personal watercraft. Even further, it provides such a vehicular exhaust system adapted to use with aircraft.

In accordance with another preferred embodiment hereof, this invention provides a vehicular muffler system related to modifying at least one pressure wave of at least one moving exhaust gas passing through at least one muffler housing having at least one exhaust gas inlet to admit the at least one moving exhaust gas, and at least one exhaust gas outlet to discharge the at least one moving exhaust gas, such system comprising: a single exhaust gas transfer passage adapted to transfer the at least one moving exhaust gas between the at least one exhaust gas inlet and the at least one exhaust gas outlet; wherein such single exhaust gas transfer passage comprises at least one cross-sectional area substantially greater than the cross-sectional area of the at least one exhaust gas inlet; and wherein such single exhaust gas transfer passage comprises a regular polygonal cross section. Moreover, it provides such a vehicular exhaust system wherein such regular polygonal cross section comprises a square. Additionally, it provides such a vehicular exhaust system wherein such regular polygonal cross section comprises a rectangle. Also, it provides such a vehicular exhaust system wherein such at least one exhaust gas transfer passage comprises at least one energy dissipater adapted to dissipate energy from the at least one pressure wave while the at least one moving exhaust gas is transferred by such at least one exhaust gas transfer passage. In addition, it provides such a vehicular exhaust system wherein such at least one energy dissipater comprises at least one gas permeable aperture within such at least one exhaust gas transfer passage. And, it provides such a vehicular exhaust system adapted to use with motorcycles. Further, it provides such a vehicular exhaust system adapted to use with all-terrain vehicles. Even further, it provides such a vehicular exhaust system adapted to use with automobiles. Moreover, it provides such a vehicular exhaust system adapted to use with personal watercraft. Additionally, it provides such a vehicular exhaust system adapted to use with aircraft.

In accordance with another preferred embodiment hereof, this invention provides a vehicular muffler system related to modifying at least one pressure wave of at least one moving exhaust gas passing through at least one muffler housing having at least one exhaust gas inlet to admit the at least one moving exhaust gas, and at least one exhaust gas outlet to discharge the at least one moving exhaust gas, such system comprising: at least one exhaust gas transfer passage adapted to transfer the at least one moving exhaust gas between the at least one exhaust gas inlet and the at least one exhaust gas outlet; wherein at least one first portion of such at least one exhaust gas transfer passage, adjacent the at least one exhaust gas inlet, comprises at least one first cross-sectional area no more than substantially equal to such at least one inlet cross-sectional area of the at least one exhaust gas inlet; wherein at least one second portion of such at least one exhaust gas transfer passage, adjacent the at least one first portion, steps up to at least one second cross-sectional area substantially larger than such at least one first cross-sectional area; wherein at least one third portion of such at least one exhaust gas transfer passage, adjacent the at least one exhaust gas outlet, comprises at least one third cross-sectional area no more than substantially equal to such at least one inlet cross-sectional area of the at least one exhaust gas inlet; and wherein such at least one exhaust gas transfer passage permits at least one unrestricted linear passage of at least one portion of the at least one moving exhaust gas from the at least one exhaust gas inlet to the at least one exhaust gas outlet.

Also, it provides such a vehicular exhaust system wherein such at least one exhaust gas transfer passage comprises at least one exhaust gas flow-accelerating portion. In addition, it provides such a vehicular exhaust system wherein such at least one exhaust gas flow-accelerating portion comprises at least one fourth portion of such at least one exhaust gas transfer passage, situate between such at least one first portion and such at least one second portion, comprising at least one fourth cross-sectional area substantially less than such at least one first cross-sectional area. And, it provides such a vehicular exhaust system wherein such at least one exhaust gas flow-accelerating portion is accomplished per "Venturi"-type constriction.

Further, it provides such a vehicular exhaust system wherein: the at least one exhaust gas outlet comprises at least one outlet cross-sectional area substantially less than the at least one inlet cross-sectional area; and at least one fifth portion of such at least one exhaust gas transfer passage, situate between such at least one third portion and the at least one exhaust gas outlet, comprises at least one fifth cross-sectional area no more than substantially equal to such at least one outlet cross-sectional area of the at least one exhaust gas outlet. Even further, it provides such a vehicular exhaust system wherein such at least one exhaust gas transfer passage further comprises at least one energy dissipater adapted to dissipate energy from the at least one pressure wave as the at least one moving exhaust gas is transferred by such at least one exhaust gas transfer passage. Moreover, it provides such a vehicular exhaust system wherein such at least one second portion comprises at least one gas expansion chamber adapted to permit expansion of the at least one pressure wave during the transfer by such at least one exhaust gas transfer passage.

Additionally, it provides such a vehicular exhaust system wherein at least one portion of such at least one exhaust gas transfer passage comprises at least one regular polygonal cross-section. Also, it provides such a vehicular exhaust system wherein such at least one regular polygonal cross-section comprises at least one square cross-section. In addition, it provides such a vehicular exhaust system adapted to use with motorcycles. And, it provides such a vehicular exhaust system adapted to use with all-terrain vehicles. Further, it provides such a vehicular exhaust system adapted to use with automobiles. Even further, it provides such a vehicular exhaust system adapted to use with personal watercraft. Moreover, it provides such a vehicular exhaust system adapted to use with aircraft.

In accordance with another preferred embodiment hereof, this invention provides a vehicular exhaust system, related to providing a tip system for directing exhaust gases from a muffler system having at least one fluid outlet comprising an effective radius R, comprising, in combination: at least one gas outlet adapted to modify and direct fluid flow out of the vehicular exhaust system; wherein such at least one gas outlet comprises at least one attachment adapted to attach such at least one gas outlet to the at least one fluid outlet, and at least one director, extending outward an average distance D from such at least one attachment, adapted to direct such exhaust gases; wherein such average distance D is no more than about R; and wherein such at least one gas outlet comprises blue-anodized titanium.

In accordance with another preferred embodiment hereof, this invention provides a vehicular exhaust system, related to modifying at least one pressure wave of at least one moving fluid, such system comprising: at least one fluid inlet to admit the at least one moving fluid; at least one fluid outlet to discharge the at least one moving fluid; at least one fluid transfer conduit adapted to transfer the at least one moving fluid from such at least one fluid inlet to such at least one fluid outlet; at least one energy dissipater adapted to dissipate energy from the at least one pressure wave during such transfer of the at least one moving fluid by such at least one fluid transfer conduit; wherein such at least one energy dissipater comprises at least one collection chamber, having length L, for collecting at least one portion of the at least one pressure wave, and at least one aperture adapted to pass the at least one portion of the at least one pressure wave from such at least one fluid transfer conduit to such at least one collection chamber; and wherein such at least one aperture comprises an effective diameter of at least 5% of such length L. Additionally, it provides such a vehicular exhaust system wherein such at least one aperture comprises two apertures each having an effective diameter of at least 5% of such length L. Also, it provides such a vehicular exhaust system wherein such at least one fluid inlet comprises at least one exhaust header. In addition, it provides such a vehicular exhaust system further comprising: at least one exhaust muffler; wherein such at least one fluid outlet is connected to permit fluid transfer with such at least one exhaust muffler. And, it provides such a vehicular exhaust system adapted to use with motorcycles.

In accordance with another preferred embodiment hereof, this invention provides a vehicular exhaust system, related to modifying at least one pressure wave of at least one moving fluid, such system comprising: at least one fluid inlet to admit the at least one moving fluid; at least one fluid outlet to discharge the at least one moving fluid; at least one fluid transfer conduit, comprising a first fluid-impervious-boundary-surface, adapted to transfer the at least one moving fluid from such at least one fluid inlet to such at least one fluid outlet; at least one energy dissipater adapted to dissipate energy from the at least one pressure wave during such transfer of the at least one moving fluid by such at least one fluid transfer conduit; wherein such at least one energy dissipater comprises at least one collection chamber for collecting at least one portion of the at least one pressure wave, and at least one aperture adapted to pass the at least one portion of the at least one pressure wave from such at least one fluid transfer conduit to such at least one collection chamber; and wherein at least one portion of such first fluid-impervious-boundary-surface is situate within such at least one collection chamber; wherein such at least one portion of such first fluid-impervious-boundary-surface comprises a boundary surface area; and wherein such at least one aperture comprises an effective area not exceeding 15% of such boundary surface area. Further, it provides such a vehicular exhaust system wherein: such at least one collection chamber comprises at least one second fluid-impervious-boundary-surface; and such at least one second fluid-impervious-boundary-surface is substantially arcuate in shape. Even further, it provides such a vehicular exhaust system wherein: such at least one aperture comprises less than sixteen apertures; at least one of such at least one apertures comprises an effective diameter of greater than about 0.3"; and at least one of such at least one apertures comprises an effective diameter of less than about 0.3". Moreover, it provides such a vehicular exhaust system wherein: such at least one aperture comprises at least two apertures each one of such at least two apertures having an effective diameter greater than about 0.3"; and such at least one aperture further comprises a plurality of apertures each having an effective diameter less than about 0.3". Additionally, it provides such a vehicular exhaust system wherein such at least one fluid inlet comprises at least one exhaust header. Also, it provides such a vehicular exhaust system further comprising: at least one exhaust muffler; wherein such at least one fluid outlet is in fluid communication with such at least one exhaust muffler.

In addition, it provides such a vehicular exhaust system adapted to use with motorcycles. And, it provides such a vehicular exhaust system adapted to use with all-terrain vehicles. Further, it provides such a vehicular exhaust system adapted to use with automobiles. Even further, it provides such a vehicular exhaust system adapted to use with personal watercraft. Even further, it provides such a vehicular exhaust system adapted to use with aircraft.

In accordance with another preferred embodiment hereof, this invention provides a vehicular exhaust system related to modifying at least one pressure wave of at least one moving exhaust gas discharged from at least one exhaust port of at least one internal combustion engine, such system comprising: at least one header pipe adapted to receive the at least one moving exhaust gas discharged from the at least one exhaust port; at least one muffler adapted to receive the at least one moving exhaust gas discharged from such at least one header pipe; wherein such at least one header pipe comprises at one first gas expansion chamber adapted to permit expansion of the at least one pressure wave during the transfer by such at least one header pipe; and wherein such at least one muffler comprises at one second gas expansion chamber adapted to permit expansion of the at least one pressure wave during the transfer by such at least one muffler. Even further, it provides such a vehicular exhaust system wherein such at one first gas expansion chamber comprises: at least one fluid inlet to admit the at least one moving exhaust gas; at least one fluid outlet to discharge the at least one moving exhaust gas; at least one exhaust gas transfer conduit, comprising a first fluid-impervious-boundary-surface, adapted to transfer the at least one moving exhaust gas from such at least one exhaust gas inlet to such at least one exhaust gas outlet; at least one energy dissipater adapted to dissipate energy from the at least one pressure wave during such transfer of the at least one moving exhaust gas by such at least one exhaust gas fluid transfer conduit; wherein such at least one energy dissipater comprises at least one collection chamber for collecting at least one portion of the at least one pressure wave, and at least one aperture adapted to pass the at least one portion of the at least one pressure wave from such at least one exhaust gas transfer conduit to such at least one collection chamber; and wherein at least one portion of such first fluid-impervious-boundary-surface is situate within such at least one collection chamber; wherein such at least one portion of such first fluid-impervious-boundary-surface comprises a boundary surface area; and wherein such at least one aperture comprises an effective area not exceeding 15% of such boundary surface area.

Even further, it provides such a vehicular exhaust system wherein such at least one muffler comprises: at least one exhaust gas inlet to admit the at least one moving exhaust gas from such at least one header pipe; at least one exhaust gas outlet to discharge the at least one moving exhaust gas; at least one exhaust gas transfer conduit adapted to transfer the at least one moving exhaust gas from such at least one exhaust gas inlet to such at least one exhaust gas outlet; and at least one outer housing adapted to essentially house such at least one exhaust gas transfer conduit; wherein such at least one outer housing comprises at least one outer periphery comprising at least one outer peripheral shape; and wherein such outer peripheral shape of a first transverse section taken at any point along such linear axis of flow is unique relative to such outer peripheral shape derived from a second transverse section taken at any other point along the same linear axis of flow.

Furthermore, it provides such a vehicular exhaust system adapted to use with motorcycles. Even further, it provides such a vehicular exhaust system adapted to use with all-terrain vehicles. Even further, it provides such a vehicular exhaust system adapted to use with automobiles. Even further, it provides such a vehicular exhaust system adapted to use with personal watercraft. And, it provides such a vehicular exhaust system adapted to use with aircraft.

BRIEF DESCRIPTION OF THE DRAWINGS

FIG. 1 shows a side view, illustrating a typical vehicle application for the exhaust system, according to a preferred embodiment of the present invention.

FIG. 2 shows an exploded view illustrating individual components comprising the typical exhaust system of FIG. 1.

FIG. 3 shows a perspective view of a muffler system, comprising an oval-to-round outer canister, according to a preferred embodiment of the present invention.

DETAILED DESCRIPTION

Figure 4:
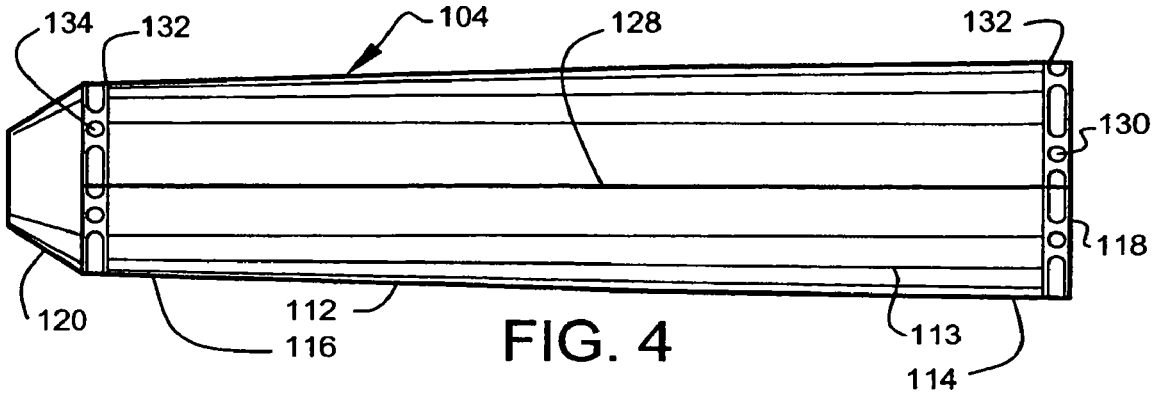
FIG. 4 shows a side view of the muffler system of FIG. 3.

The following detailed description will be accomplished by reference to preferred embodiments and will include Applicant's current best understanding of the theory of operation of the preferred embodiments. However, Applicants do not regard themselves as bound, or their invention limited, by any particular theory of operation expressed herein, as some uncertainties exist, even in the underlying science itself.

FIG. 1 is a side view illustrating a typical vehicle application for exhaust system 100. In FIG. 1, exhaust system 100 has been incorporated into first example vehicle 101, as shown. For the purpose of the present disclosure, first example vehicle 101 comprises a four-stroke off-road motorcycle having a displacement of about 450 cc. First example vehicle 101 may preferably comprise an off-road motorcycle generally matching the specifications of model CRF 450 produced by Honda Motor Co., Inc., as shown. Those skilled in the art will appreciate that first example vehicle 101 may comprise any number of vehicle types, for both street and off-road use, having either smaller or larger engine displacements. It should be further noted that, although exhaust system 100 is preferred for and especially adaptable to smaller displacement engines, such as those powering motorcycles, ATVs, snowmobiles, personal watercraft, etc., exhaust system 100 is adaptable, under appropriate circumstances, to vehicles comprising larger displacement engines including automobiles, trucks, and aircraft. Those of ordinary skill in the art, upon reading this specification will understand that, under appropriate circumstances, a number of component combinations, derived from the basic components of exhaust system 100, are adaptable to both four-stroke and two-stroke engines, although it is highly preferred to use exhaust system 100 with four-stroke engines.

Preferably, exhaust system 100 is adapted to fully replace the manufacturer's original exhaust system, as shown. Preferably, exhaust system 100 is designed to fit first example vehicle 101 without significant modification, as shown. Exhaust system 100 is preferably adapted to attach to first example vehicle 101 using all, or under appropriate circumstances a majority of, the original equipment (hereinafter referred to as OE) support mountings, as shown. As one typical example, inlet flange 103 of header system 102 preferably bolts directly to exhaust port 105 of first example vehicle 101 using the manufacturer's original, unmodified, mounting studs, as shown.

FIG. 2 is a perspective view illustrating the individual components comprising exhaust system 100 of FIG. 1. Preferably, exhaust system 100 comprises header system 102, muffler system 104, and modular end-cap 106, as shown. Depending on the vehicle application, exhaust system 100 may preferably include vehicle specific adaptations, such as, mid-pipe 108, as shown. Preferably, header system 102 comprises a specialized flow-enhancing power chamber 110, as shown. Although exhaust system 100 is designed as a complete replacement for OE exhaust systems, it should be noted that exhaust system 100 is modular in structure, such that any single component or combination of components can be incorporated within a vehicular exhaust system to increase overall performance. Upon reading this specification those of ordinary skill in the art will understand that, under appropriate circumstances, considering such issues as user preference, advances in vehicle design, intended vehicle application, etc., other system configurations from those illustrated, such as, the use of alternate mounting tabs, single piece header pipes, alternately configured muffler housings, conical end-caps, etc., may suffice.

The following descriptions refer to individual components of exhaust system 100. FIG. 3 through FIG. 13 show primarily novel improvements to the exterior shape of vehicle muffler canisters.

Figure 13:
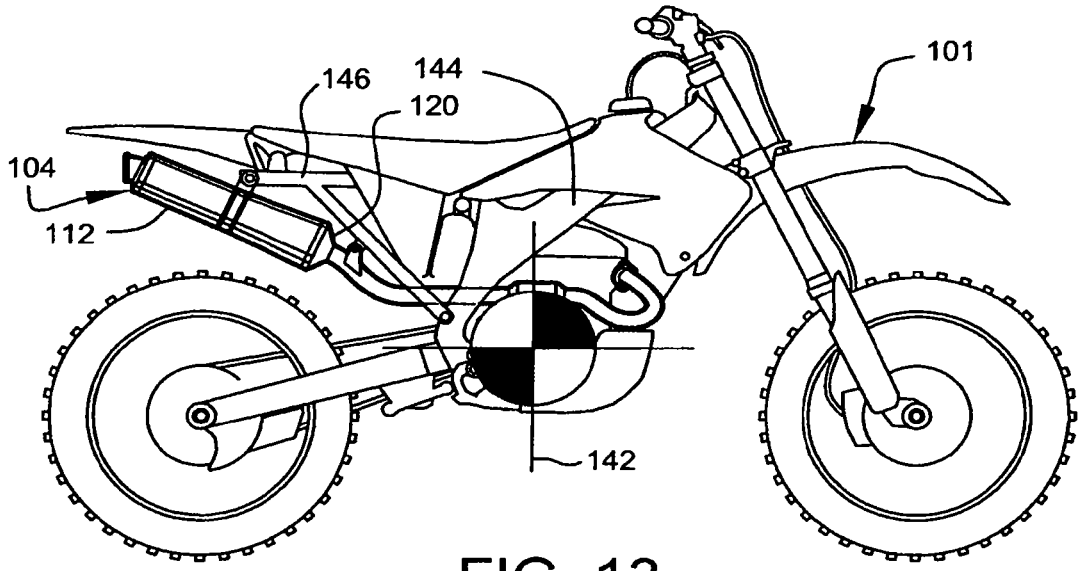
FIG. 13 shows a side view illustrating improved weight distribution in the typical vehicle application according to the preferred embodiment of FIG. 1.

The novel transitioning external shape of muffler system 104 is effective in permitting a centralizing of the muffler mass relative to the center of mass of the vehicle (see FIG. 13 for expanded discussion). As previously noted, any mass located away from the engine (typically the approximate center of mass of a motorcycle) applies a rotational moment to the vehicle system, often making the vehicle unbalanced. The novel external shapes of muffler system 104 move the mass (muffler) closer to the engine, thus improving the overall handling and performance of the vehicle (see FIG. 13 for expanded discussion).

FIG. 3 shows a perspective view of muffler system 104, comprising a unique oval-to-round outer canister 112, according to a preferred embodiment of the present invention. Preferably, oval-to-round outer canister 112 comprises a generally elongated housing having a longitudinal axis 138 extending parallel with the axis of gas flow through the muffler. Preferably, oval-to-round outer canister 112 comprises an outer perimeter surface that smoothly transitions from a substantially circular outer portion 114 to a substantially oval outer portion 116, as shown.

Preferably, the outer sidewall 113 of oval-to-round canister 112 is constructed from a single, generally flat sheet that is shaped into an elongated, generally tubular form, as shown. Preferably, each end of oval-to-round canister 112 comprises either an inlet end-cap 118 or outlet end-cap 120, as shown. Preferably, circular outer portion 114 (at least herein embodying at least one exhaust gas outlet to discharge the at least one moving exhaust gas) is situated adjacent outlet end-cap 118, as shown. Preferably, oval outer portion 116 (at least embodying herein at least one exhaust gas inlet to admit the at least one moving exhaust gas) is situated adjacent removable inlet end-cap 120, as shown. Upon reading this specification, those of ordinary skill in the art will understand that, under appropriate circumstances, such as, for example, the use of a oval-to-round-type muffler in alternate vehicle chassis configurations, etc., other arrangements, such as, utilizing an oval shape at the outlet end of the muffler, use of other polygonal shapes, conic sections, etc., may suffice.

Preferably, the outer geometry of oval-to-round canister 112 is generated by forming outer sidewall 113 around the dissimilar outer peripheral shapes of inlet end cap 120 and outlet end cap 118, as shown. In so doing, oval-to-round canister 112 comprises a unique outer peripheral shape wherein essentially no two transverse cross sections are the same (at least embodying herein wherein substantially each of such outer peripheral shapes of transverse sections taken at different points along such linear axis of flow is different from each other such outer peripheral shape taken at another transverse section). This preferred canister arrangement permits the development of highly specialized muffler embodiments and directly contributes to providing improved vehicle clearance and weight distribution while maintaining maximum interior canister volume for flow/sound modification (as further described in FIG. 12 and FIG. 13).

Preferably, outer sidewall 113 is formed from a durable and lightweight material. Preferably, outer sidewall 113 is construction from a substantially rectangular sheet, as shown. Preferred materials used to form sidewall 113 are selected based intended use and material cost. In performance embodiments of muffler system 104, sidewall 113 is preferably constructed from ASTM B 265 GR 2 titanium having a thickness of about 0.025". In alternate preferred embodiments, sidewall 113 is preferably constructed from aluminum or stainless steel. In alternate preferred embodiments where weight is critical to performance, sidewall 113 is preferably constructed from a carbon fiber composite. Upon reading this specification those of ordinary skill in the art will understand that, under appropriate circumstances, considering such issues as user preference, advances in technology, performance criteria, etc., other construction materials, such as mild steel, hybrid composites, metallic alloys, high-performance resins, fiberglass, molded polymers, etc., may suffice.

Preferably, oval-to-round canister 112 of muffler system 104 houses at least one internal exhaust transfer core 126 for transferring a flow of exhaust gas from inlet aperture 122 (see FIG. 6) to outlet aperture 124, as shown. Preferably, oval-to-round outer canister 112 is adapted to house a high performance straight-through core, as shown (at least embodying herein wherein such at least one exhaust gas transfer conduit permits at least one unrestricted passage of at least one portion of the at least one moving exhaust gas from such at least one exhaust gas inlet to such at least one exhaust gas outlet along a linear axis of flow). As described in later embodiments of the present invention, muffler system 104 preferably comprises a range of internal structures adapted to modify or alter the dynamics of the energy associated with passage of the exhaust gas flow through the system. Under appropriate circumstances, the oval-to-round canister design of muffler system 104 is adaptable to house a wide range of gas-flow modification technologies. As an example, oval-to-round canister design of muffler system 104 is adaptable to function as a hybrid sound energy absorption-type muffler or silencer. Upon reading this specification, those of ordinary skill in the art will understand that, under appropriate circumstances, considering issues such as user preference, advances in vehicle design, intended vehicle application, etc., the use of other muffler/sound modification technologies, in conjunction with the oval-to-round design, such as, for example, restrictors, reflectors, resonators, active and passive wave canceling structures, multi-channel cores, etc., may suffice.

Figure 5:
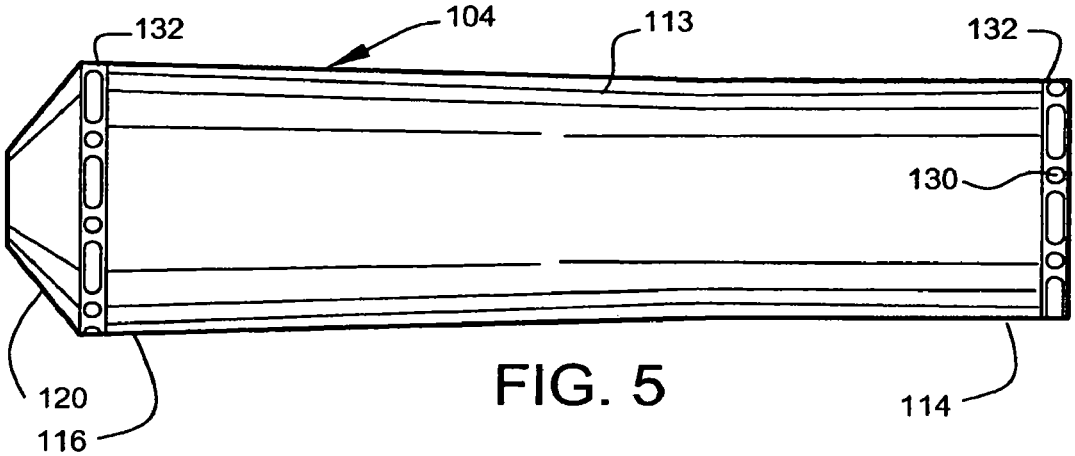
FIG. 5 shows a top view of the muffler system of FIG. 3.

FIG. 4 shows a side view of muffler system 104. FIG. 5 shows a top view of muffler system 104 according to the preferred embodiment of FIG. 3. Referring now to both FIG. 4 and FIG. 5, the side view of FIG. 4 most clearly illustrates the preferred inlet-to-outlet transition of oval-to-round canister 112 (at least embodying herein wherein such at least one outer housing comprises at least one outer periphery comprising at least one outer peripheral shape). The preferred transitioning profile of oval-to-round canister 112 (at least embodying herein at least one outer housing adapted to essentially house such at least one exhaust gas transfer conduit) directly contributes to providing improved vehicle clearance and weight distribution characteristics while maintaining maximum interior canister volume for flow/sound modification (as will be further described in FIG. 12 and FIG. 13).

Preferably, two parallel edges of the rectangular sheet material comprising oval-to-round canister 112 are brought together to form a substantially tubular shape, as shown. Preferably, the two parallel edges are permanently joined at seam 128, as shown. Preferably, seam 128 extends longitudinally along the length of oval-to-round canister 112, as shown. Preferably, seam 128 is permanently formed, by welding, to maximize strength and durability. Upon reading this specification, those of ordinary skill in the art will understand that, under appropriate circumstances, such as intended use, advances in technology, cost, etc., other means of forming a permanent seam, such as folded interlocking, bonding, mechanically fastening, fusing, cohering, etc., may suffice.

Preferably, outlet end-cap 118 is permanently fastened to outer sidewall 113 using rivets 130, as shown. Preferably, rivets 130 pass though a reinforcing retaining band 132 before extending through outer sidewall 113 to secure outlet end-cap 118 in position, as shown. Preferably, retaining band 132 is constructed from 304 stainless steel having a thickness of about 0.024". Preferably, inlet end-cap 120 is removably fastened to outer sidewall 113 using six allen-head screws 134, as shown. Preferably, allen-head screws 134 pass though a similar reinforcing retaining band 132 before extending through outer sidewall 113 to removably secure inlet end-cap 120 in position, as shown. The preferred use of removable fasteners on at least one end of oval-to-round canister 112 permits convenient access to the interior of the canister for inspection and service. For example, it is common, in specific muffler arrangements, to inspect and replace sound attenuating packing material after a predetermined period of service.

Figure 6:
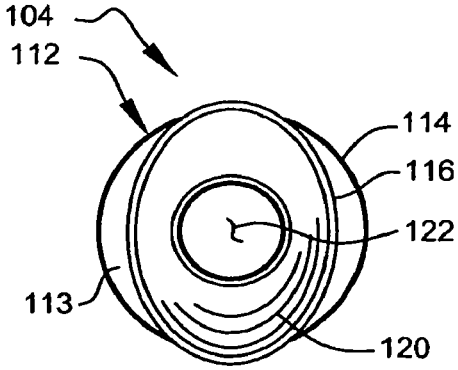
FIG. 6 shows an end view of the inlet of the muffler system of FIG. 3.
Figure 7:
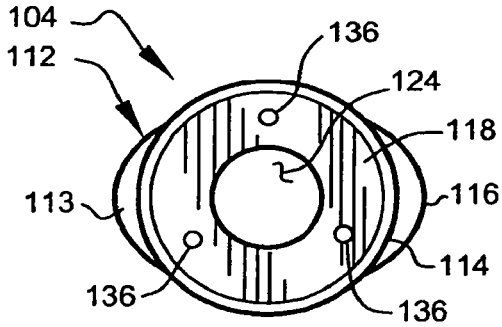
FIG. 7 shows an end view of the outlet of the muffler system of FIG. 3.

FIG. 6 shows an end view of inlet end-cap 120 of muffler system 104. FIG. 7 shows an end view of outlet end-cap 118 of muffler system 104 according to the preferred embodiment of FIG. 3. Referring now to both FIG. 6 and FIG. 7, with continued reference to the prior figures, inlet end-cap 120 preferably comprises inlet aperture 122, as shown. Preferably, inlet aperture 122 is concentrically positioned on axis with circular outer portion 114 of oval-to-round canister 112, as shown. Inlet end-cap 120 may preferably comprise one or more alternate shapes depending on vehicle application. For example, inlet end-cap 120 of muffler system 104 (as illustrated in FIG. 1 and FIG. 2) comprises a shape that is elongated and generally conical. In first example vehicle 101, the conically shaped inlet end-cap 120 provides greater heel clearance for the rider, increases muffler volume, and in conjunction with the oval-to-round canister shape, permits improved positioning of muffler system 104 within the chassis, as shown. Additionally, conically shaped inlet end-cap 120 permits the interior core to be shifted toward the inlet to improve overall vehicle weight balance. Other vehicle specific embodiments of inlet end-cap 120 may be relatively flat in configuration as to not project beyond the end of outer sidewall 113. Upon reading this specification, those of ordinary skill in the art will now understand that, under appropriate circumstances, considering such factors as rider preference, advances in vehicle technology, intended vehicle application, etc., modifying of the inlet end-cap to include other shapes, sizes and application specific structures, such as mounting tabs, spring retainers, adapters, etc., may suffice.

Preferably, outlet end-cap 118 comprises outlet aperture 124 also about concentrically positioned on axis with circular outer portion 114 of oval-to-round canister 112, as shown. Preferably, outlet end-cap 118 comprises three internally threaded sockets 136 equally spaced about outlet aperture 124, as shown. Preferably, threaded sockets 136 are adapted to receive allen-head bolts used to removably retain modular end-cap 106 adjacent outlet end-cap 118 (see FIG. 1). Preferably, both inlet end-cap 120 and outlet end-cap 118 are constructed from a durable and corrosion resistant material, preferably stainless steel, or titanium. Under appropriate circumstances, considering such issues as cost and intended use, both inlet end-cap 120 and outlet end-cap 118 may comprise alternate materials, such as, for example, cast or milled aluminum.

Figure 8:
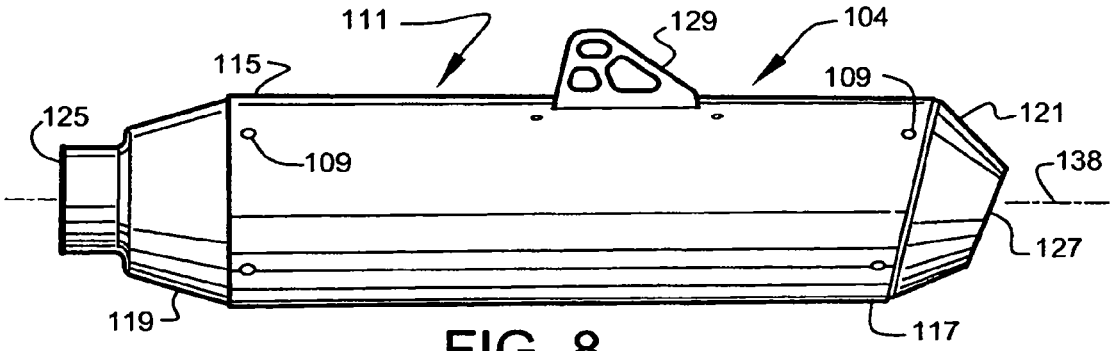
FIG. 8 shows a side view of a muffler system, comprising an oval-to-oval outer canister, according to another preferred embodiment of the present invention.

FIG. 8 shows a side view of muffler system 100, comprising oval-to-oval canister 111, according to another preferred embodiment of the present invention. Preferably, oval-to-oval canister 111 comprises an outer perimeter surface that smoothly transitions from a first oval-shaped end portion 115 to a second, non-congruent, oval-shaped end portion 117, as shown (at least embodying herein wherein such at least one outer housing comprises at least one outer periphery comprising at least one outer peripheral shape). Preferably, oval-to-oval canister 111 comprises an elongated housing having a longitudinal axis 138 extending generally parallel with the axis of gas flow through the muffler. The unique outer shape of oval-to-oval canister 111 directly contributes to providing improved vehicle clearance and weight distribution while maintaining maximum interior canister volume for flow/sound modification (as will be further described in FIG. 12 and FIG. 13). Upon reading this specification, those of ordinary skill in the art will understand that, under appropriate circumstances, such as, for example, the use of an oval-to-oval muffler in alternate vehicle chassis configurations, other arrangements, such as, forming outer shapes using other conic sections, use of complex closed polygonal outer shapes, outer shaped derived from Bezier curves, etc., may suffice.

Preferably, each end of oval-to-oval canister 111 comprises either an inlet end-cap 119 or outlet end-cap 121, as shown. Preferably, the outer geometry of oval-to-oval canister 111 is generated by forming outer sidewall 123 around the dissimilar outer peripheral shapes of inlet end-cap 119 and outlet end-cap 121, as shown. By this means, oval-to-oval canister 111 comprises a unique outer peripheral shape wherein essentially no two transverse cross sections are the same (at least embodying herein wherein substantially each of such outer peripheral shapes of transverse sections taken at different points along such linear axis of flow is different from each other such outer peripheral shape taken at another transverse section). This preferred canister arrangement permits the development of highly specialized muffler embodiments capable of improving vehicle clearances and weight distribution.

Preferably, outer sidewall 123 (at least embodying herein at least one outer housing adapted to essentially house such at least one exhaust gas transfer conduit) is formed from a durable and lightweight material. Preferably, outer sidewall 123 is construction from a substantially rectangular sheet having a substantially thin and uniform thickness, as shown. As in the prior embodiment, preferred materials used to form outer sidewall 123 are selected based on intended use and material cost. In performance embodiments of muffler system 104, sidewall 123 is preferably constructed from ASTM B 265 GR 2 titanium having a thickness of about 0.025". In alternate preferred embodiments, sidewall 123 is preferably constructed from sheet aluminum or sheet stainless steel. In alternate preferred embodiments where weight is critical to performance, sidewall 123 is preferably constructed from one or more carbon fiber composites. Upon reading this specification those of ordinary skill in the art will understand that, under appropriate circumstances, considering such issues as user preference, advances in technology, performance criteria, etc., other construction materials and or sheet thicknesses, such as mild steel, hybrid composites, metallic alloys, high-performance resins, fiberglass, molded polymers, etc., may suffice.

Preferably, oval-to-oval canister 111 comprises an integral muffler mount 129 adapted to permit secure mounting to a vehicle. Preferably, muffler mount 129 comprises a machined aluminum bracket having a mounting flange mechanically fastened to the interior of sidewall 123, as shown. Preferably, muffler mount 129 passes through slot aperture 131 formed within sidewall 123, as shown. The location of muffler mount 129 is determined by the mounting requirements of the vehicle. Upon reading the teachings of this specification, those of ordinary skill in the art will now understand that, under appropriate circumstances, considering such issues as user preference, intended use, etc., other mounting arrangements, such as the use of brackets integrally formed within the housing, cast brackets, wire clips, etc., may suffice. Furthermore, those with ordinary skill in the art will now understand that, under appropriate circumstances, considering such issues as vehicle type, in-service durability, muffler mounting position, etc., other muffler mounting methods, such as the use of removable brackets, OEM straps, removable mounting clips, wire rings, etc., may suffice.

Figure 9:
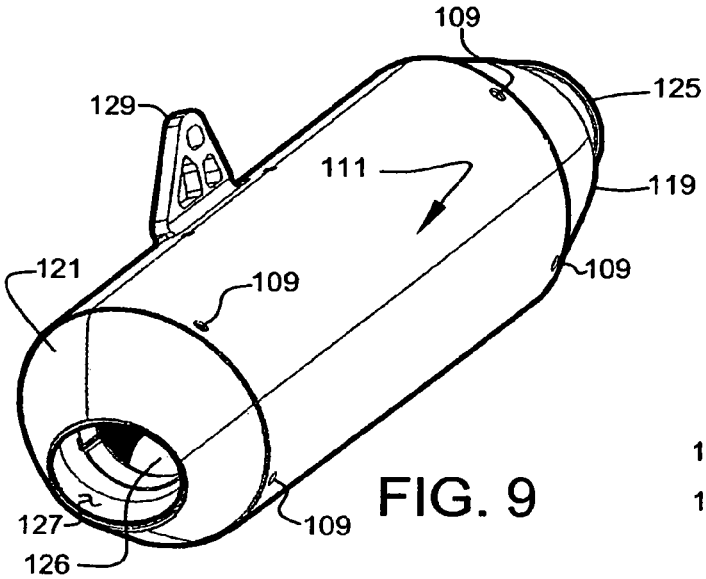
FIG. 9 shows a perspective view of the oval-to-oval canister of FIG. 8.

FIG. 9 shows a perspective view of oval-to-oval canister 111 of FIG. 8. Preferably, sidewall 123 is joined to inlet end-cap 119 and outlet end-cap 121 using mechanical fasteners 109, as shown. Preferably, oval-to-oval canister 111 (at least embodying herein at least one outer housing adapted to essentially house such at least one exhaust gas transfer conduit) of muffler system 104 houses at least one internal exhaust transfer core 126 for transferring a flow of exhaust gas from inlet aperture 125 to outlet aperture 127, as shown. Preferably, oval-to-oval canister 111 is adapted to house a high performance straight-through core, as shown (at least embodying herein wherein such at least one exhaust gas transfer conduit permits at least one unrestricted passage of at least one portion of the at least one moving exhaust gas from such at least one exhaust gas inlet to such at least one exhaust gas outlet along a linear axis of flow). As described in later embodiments of the present invention, muffler system 104 preferably comprises a range of internal structures adapted to modify or alter the dynamics of the energy associated with passage of the exhaust gas flow through the system. Under appropriate circumstances, the oval-to-oval canister design of muffler system 104 is adaptable to house a wide range of gas-flow modification technologies.

Figure 10:
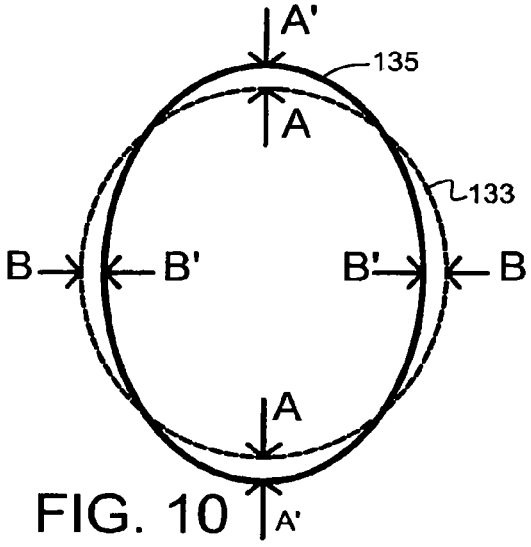
FIG. 10 shows a diagram illustrating the perimeter shapes of a first end portion and a second end portion of the oval-to-oval canister of FIG. 8.

FIG. 10 shows a diagram illustrating the perimeter shapes of a first end portion 133 and a second end portion 135 of the oval-to-oval canister of FIG. 8. Preferably, first end portion 133 (illustrated by dashed lines) and second end portion 135 comprise non-congruent ovals, as shown. It should be noted that, under appropriate circumstances, considering such issues as vehicle application, manufacturing methodologies, etc., the development of alternate end portion shapes, such as, mathematically defined ellipses, closed polygonal shapes, complex closed concave curves, etc., may suffice. Furthermore, the two end shapes may preferably share vertices, be confocal, or comprise a special rotation of one end axis relative to the other end axis.

Preferably, the end shapes of oval-to-oval outer canister 111 are selected to achieve a superior fit of the muffler canister to the vehicle. For example, an oval-to-oval outer canister 111 adapted for first example vehicle 101 comprises two distinctly dissimilar elliptical shapes, as shown. Preferably, the major axis of first end portion 133, indicated by arrows A-A, is preferably shorter than the major axis of second end portion 135 indicated by arrows A'-A'. Preferably, the minor axis of first end portion 133, indicated by arrows B-B, is wider than the minor axis of second end portion 135 indicated by arrows B'-B'. Forming a sidewall about first end portion 133 and second end portion 135 produces an outer peripheral shape wherein essentially no two transverse cross sections are the same. This preferred canister arrangement permits the development of highly specialized muffler embodiments capable of improving canister fit, vehicle clearances, and vehicle weight distribution.

Figure 11:
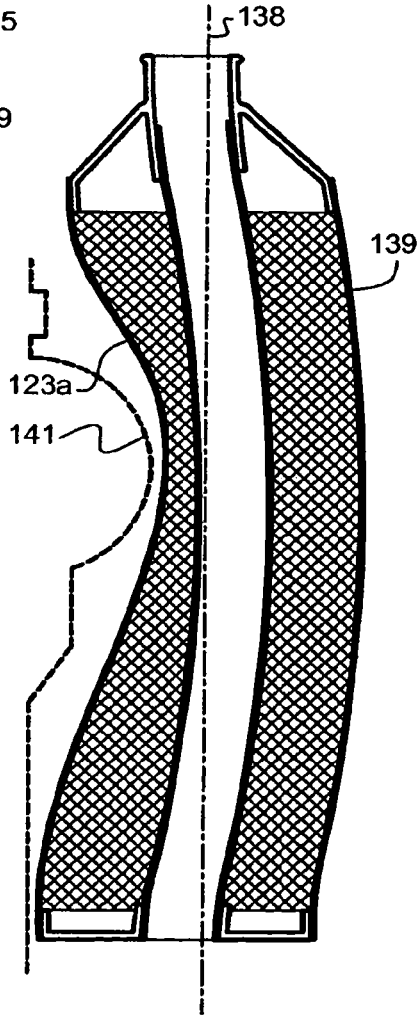
FIG. 11 shows a section through a shaped canister of an example muffler according to another preferred embodiment of the present invention.

FIG. 11 shows a section through shaped canister 139 of an example muffler according to another preferred embodiment of the present invention. Shaped canister 139 further illustrates the potential benefits of developing specialized outer housing shapes. In the example of FIG. 11, shaped canister 139 has been further adapted to fit closely within the vehicle structure 141 by further modifying the shape of outer sidewall 123*a*, as shown. Preferably, outer sidewall 123*a* smoothly transitions between each dissimilar end shape, as shown. Preferably, shaped canister 139 comprises additional intermediate shaping adapted to further match shaped canister 139 to vehicle structure 141 thus centralizing the mass of the muffler within vehicle structure 141, as shown (see also FIG. 13 for expanded discussion). Again, the present invention produces a muffler system having a specialized outer peripheral shape wherein essentially no two transverse cross sections are the same.

Figure 12:
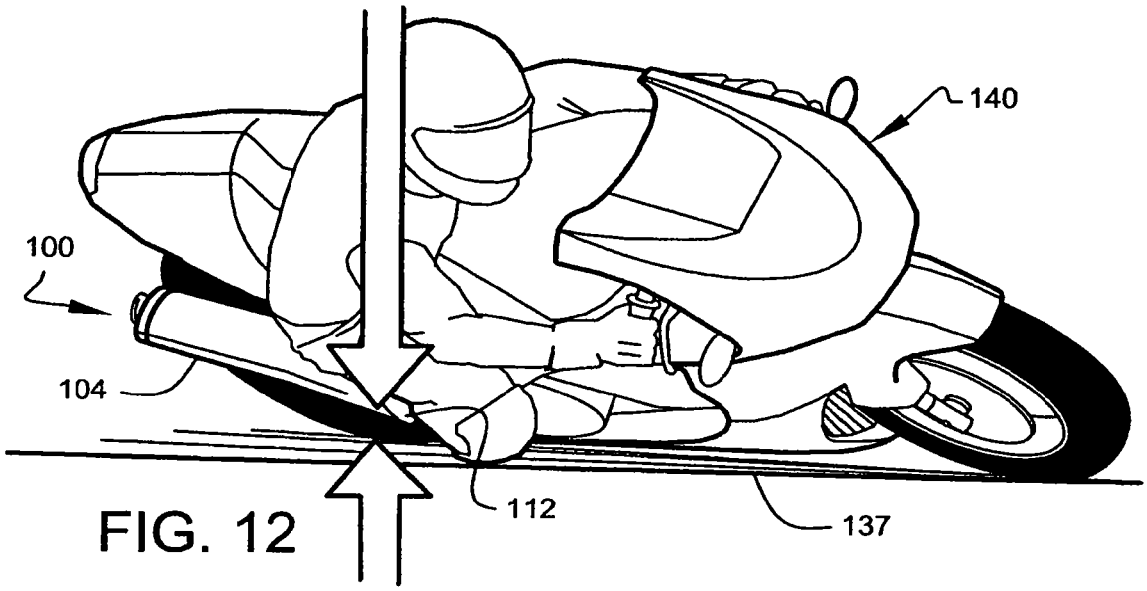
FIG. 12 shows a perspective view illustrating the clearance-increasing aspects of the muffler system of FIG. 3, FIG. 8, and FIG. 11.

FIG. 12 shows a perspective view illustrating the clearance-increasing aspects of muffler system 104 according to FIG. 3, FIG. 8, and FIG. 11. In the illustrated example of FIG. 12, muffler system 104 has been incorporated into second example vehicle 140, as shown. For the purpose of the present disclosure, second example vehicle 140 comprises a road-driven sport or racing motorcycle, as shown. It should be noted that, under appropriate circumstances, second example vehicle 140 preferably comprises a complete exhaust system 100.

A high performance motorcycle rider negotiating a corner at high speed will preferably lean the motorcycle into the turn, as shown. A skillful operator will seek a state of equilibrium wherein the angle of lean effectively balances several opposing moments; one due to centrifugal forces acting outward, one due to the gyroscopic forces generated by the spinning wheels, and one generated by the gravitational forces acting downward. Those familiar with road racing motorcycles will appreciate that, at high cornering speeds, the rider preferably leans the motorcycle to an extremely low angle relative to road surface 137, as shown. Typically, the angle position the motorcycle assumes through the corner depends on the radius of the turn, the speed of the machine and, in some situations, the clearance between external structures of second example vehicle 140, and road surface 137, as shown. In use, muffler system 104 is beneficial to the handling and performance of second example vehicle 140 by effectively increasing clearances, at critical points between the side of the vehicle and road surface 137, during high-speed cornering, as shown.

FIG. 13 shows a side view illustrating improved weight distribution in first example vehicle 101 according to the preferred embodiment of FIG. 1. Off-road vehicles, such as first example vehicle 101, are similarly subject to substantial moment forces during operation. This condition is of concern at all times during operation, and is especially important, as first example vehicle 101 becomes airborne on exiting a jump. First example vehicle 101 often operates in a manner more akin to an aircraft (extreme examples occurring during freestyle-type competitions). In fact, many of the same force interactions that govern the behavior of an aircraft apply to an airborne motorcycle. Balance and control of the motorcycle is of primary interest to both on-road and off-road riders. One strategy to improve balance and control is to reduce moments of inertia and the resultant inertial forces acting on the motorcycle by concentrating the mass of the vehicle tightly about the motorcycle's center of gravity 142. The center of gravity is generally defined as the point in a body at which the entire mass may be assumed to be concentrated (this is also coextensive with the center of mass). In a distributed mass, such as first example vehicle 101, center of gravity 142 may be generally defined as the "average location" of its parts.

As previously described, the unique external shape of muffler system 104 permits the system to be positioned deeper within chassis 144, closer to center of gravity 142, as shown. This "centralizing" of muffler system 104 is possible using oval-to-round canister 112, oval-to-oval outer canister 111, or other preferred embodiments of the invention, without interfering with the rear of the bike chassis (including suspension and brake components) and sub-frame 146, as shown. Moreover, this preferred positioning of muffler system 104 lowers and centralizes the center of gravity 142 of first example vehicle 101, to improve handling and control, without sacrificing the internal volume of muffler system 104, as shown. For some applications, muffler system 104 may comprise a longer core/canister to produce a quieter muffler due to the added length afforded at tapered inlet end-cap 120, as shown. Furthermore, when compared to the OE muffler, muffler system 104 projects a shorter distance from the rear of the motorcycle and is therefore less susceptible to damage.

Both first example vehicle 101 and second example vehicle 140 gain from the beneficial shape afforded by the use of muffler system 104 and exhaust system 100. Both first example vehicle 101 and second example vehicle 140 also benefit from the reduced mass afforded by the use of lightweight materials in muffler system 104 and exhaust system 100. In many vehicle applications, exhaust system 100 comprises a weight fifty percent lighter than the OE exhaust system. An additional benefit of the oval-to-round and oval-to-oval designs is the ability to produce a longer and quieter muffler, without sacrificing weight limits, handling or general performance.

Figure 14:
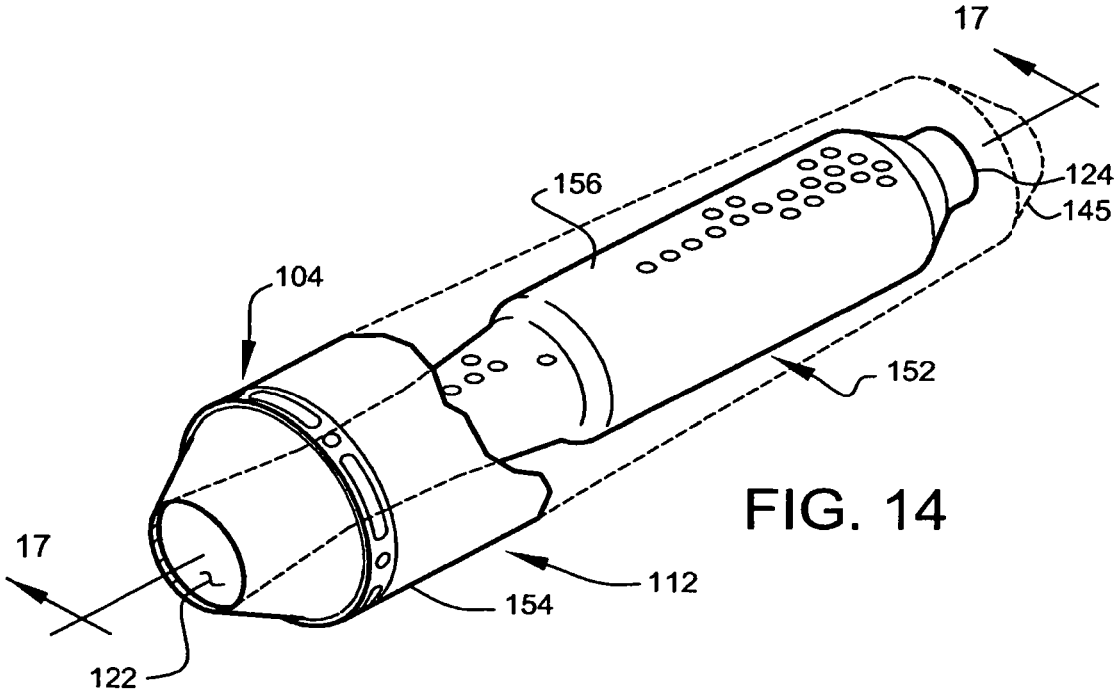
FIG. 14 shows a partial cut-away perspective view, of a muffler comprising a chambered core, according to a preferred embodiment of the present invention.

FIG. 14 is a partial cut-away perspective view, of muffler system 104 comprising chambered core 152, according to a preferred embodiment of the present invention. Chambered core 152 comprises one of several preferred internal embodiments of muffler system 104. Preferably, chambered core 152 functions to efficiently transfer a flow of exhaust gas from inlet aperture 122 to an outlet aperture 124 (at least embodying herein at least one exhaust gas outlet), as shown. Preferably, outlet aperture 124 comprises an area of cross section about equal to the cross sectional area of inlet aperture 122. In vehicle applications having specific sound emission limits, outlet aperture 124 preferably comprises a sound reducing cross sectional area less than the cross sectional area of inlet aperture 122. The unique gas flow dynamics of chambered core 152 permits outlet aperture 124 to comprise a smaller area than inlet aperture 122 without significant reduction in flow performance through the muffler. Most preferably, outlet aperture 124 comprises a sectional area approximately equaling the cross sectional area of inlet aperture 122 with reduction of exhaust outlet areas controlled by end cap 145, as shown. In this manner, the overall performance of muffler system 104 can be "tuned" to match a required vehicle operating parameter by selection of an end cap having an outlet area adapted to produce the desired operating parameter.

Chambered core 152 is typically situated within outer casing 154, as shown. Preferably, outer casing 154 comprises a structure matching the canister configurations, of FIG. 1 through FIG. 13, as shown. Upon reading this specification, those of ordinary skill in the art will understand that, under appropriate circumstances, such as user preference, advances in technology, intended vehicle application, etc., other outer canister shapes, such as round, oval, square, polygonal, etc., used in combination with the chamber core arrangement, may suffice.

Figure 15:
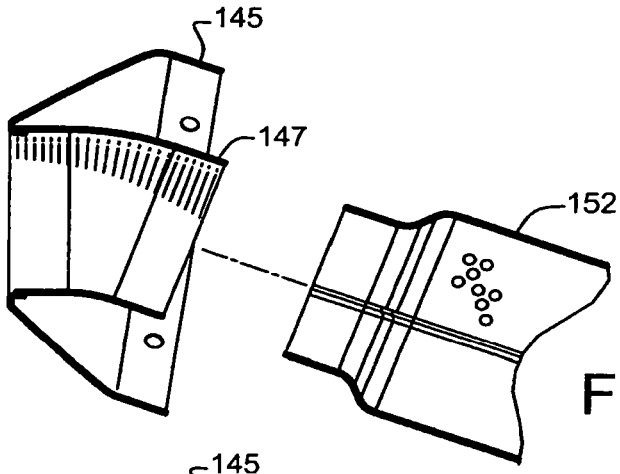
FIG. 15 shows a partial cut-away view of an end receiver adapted to receive the chambered core of FIG. 14.
Figure 16:
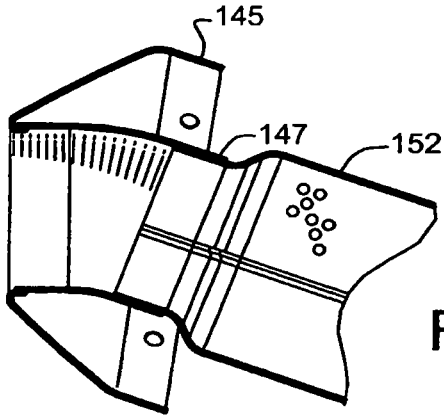
FIG. 16 shows a partial cut-away view of the end receiver of FIG. 15 coupled to the chambered core of FIG. 14.

FIG. 15 shows a partial cut-away view of end receiver 143 adapted to receive chambered core 152 of FIG. 14. FIG. 16 shows a partial cut-away view of end receiver 143 coupled to chambered core 152. Referring to both FIG. 15 and FIG. 16, preferably, end receiver 143 is adapted to engage chambered core 152 to fix chambered core 152 within outer casing 154, as shown. Preferably, end receiver 143 comprises tube 147 that is welded to end cap 145, as shown. Preferably, the interior diameter of tube 147 is sized to permit chambered core 152 to fit within tube 147, as shown. Preferably, chambered core 152 is frictionally held by end cap 145 to permit removal of end cap 145 for inspection and servicing. Preferably, end cap 145 is formed from ASTM 265 titanium sheet having a thickness of about 0.027". Preferably, tube 147 comprises a section of titanium tube having a diameter of about 1¾" and a thickness of about 0.035". Upon reading the teachings of this specification, those of ordinary skill in the art will now understand that, under appropriate circumstances, considering such issues as user preference, intended use, etc., other end receiver arrangements, such as billet milled caps, cast caps, use of materials such as stainless steel, aluminum, alternated sheet gauges, etc., may suffice.

Figure 17:
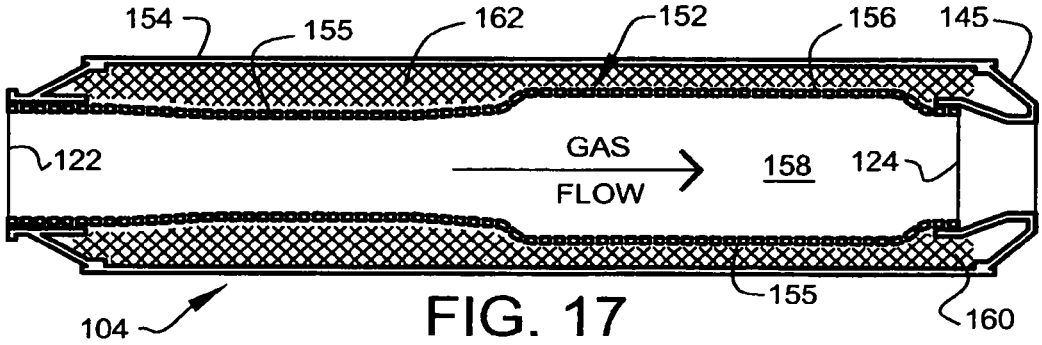
FIG. 17 shows a sectional view through the section 17-17 of FIG. 14.

FIG. 17 shows a sectional view through the section 17-17 of FIG. 14. Preferably, chambered core 152 comprises, in section, an elongated tube having a plurality of shape transitions adjacent at least one enlarged chamber, as shown. Preferably, core wall 156 of chambered core 152 comprises a plurality of perforations 155, as shown. Preferably, perforations 155 permit fluid communication of exhaust gases between interior portion 158 (at least embodying herein at least one exhaust gas transfer conduit adapted to transfer the at least one moving exhaust gas from such at least one exhaust gas inlet to such at least one exhaust gas outlet) and interstitial space 160 located between chambered core 152 and outer casing 154 (at least embodying herein at least one outer housing adapted to essentially house such at least one exhaust gas transfer conduit), as shown. Typically, interstitial space 160 is packed with a gas-permeable sound-attenuating material 162 such as steel wool, fiberglass, ceramic fiber, or similar high temperature fibrous media, as shown. It should be noted that effective sound modification is also achieved without the use of any packing material.

Figure 18:
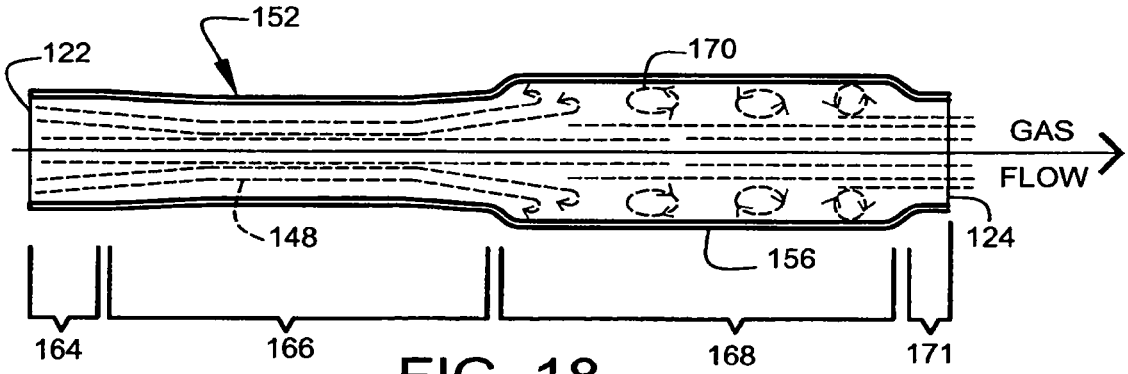
FIG. 18 shows a sectional diagram through the chambered core of FIG. 14.

Referring to now FIG. 18 with continued reference to FIG. 17, FIG. 18 shows a sectional diagram through chambered core 152 of FIG. 14. Preferably, chambered core 152 comprises a substantially straight-through design to permit a substantially uninterrupted transfer of gas flow 148 from inlet aperture 122 (at least embodying herein at least one exhaust gas inlet) to outlet aperture 124, as shown (at least embodying herein wherein such at least one exhaust gas transfer passage permits at least one unrestricted linear passage of at least one portion of the at least one moving exhaust gas from the at least one exhaust gas inlet to the at least one exhaust gas outlet).

Preferably, the first stage of chambered core 152, adjacent inlet aperture 122, comprises inlet portion 164, as shown. Preferably, inlet portion 164 comprises an essentially uniform inner diameter approximately matching the inner diameter of inlet aperture 122 (at least embodying herein wherein at least one first portion of such at least one exhaust gas transfer passage, adjacent the at least one exhaust gas inlet, comprises at least one first cross-sectional area no more than substantially equal to such at least one inlet cross-sectional area of the at least one exhaust gas inlet). Preferably, the second stage of chambered core 152 consists of accelerator portion 166, as shown. Preferably, accelerator portion 166 comprises a "Venturi"-type constriction of reduced sectional area, as shown (at least embodying herein wherein such at least one exhaust gas flow-accelerating portion comprises at least one fourth portion of such at least one exhaust gas transfer passage, situate between such at least one first portion and such at least one second portion, comprising at least one fourth cross-sectional area substantially less than such at least one first cross-sectional area). Preferably, accelerator portion 166 (at least embodying herein at least one exhaust gas flow-accelerating portion) functions to modify gas flow 148 by increasing its speed and, thereby, reducing its pressure generated against sound-attenuating material 162. The third stage of chambered core 152 preferably consists of chamber 168, as shown (at least embodying herein wherein at least one second portion of such at least one exhaust gas transfer passage, adjacent the at least one first portion, steps up to at least one second cross-sectional area substantially larger than such at least one first cross-sectional area). Applicant's understanding of the theory of operation is that, as the accelerated exhaust-gas pulse of gas flow 148 exits accelerator portion 166 and enters chamber 168, it "rolls" out in an annular (smoke ring) fashion, as shown. Preferably, chamber 168 prevents gas-pressure obstruction of the outlet of accelerator portion 166. Preferably, eddies 170 are created that roll along core wall 156, as shown. The flow dynamic of eddies 170 preferably aide in evacuation of chamber 168 between pulses and further function to minimize return waves that are generated as the exhaust pulse reflects off of the atmosphere at outlet aperture 124. Utilizing the above-described arrangements of chambered core 152 permits outlet portion 171, and or end cap 145 to comprise a smaller diameter than inlet portion 164 without significant reduction in flow performance. The preferred structure and arrangement of chambered core 152 produces low engine RPM performance matching a core of much larger cross sectional area while producing the reduced sound emissions associated with a much smaller core. This is equally beneficial at higher engine speeds where a smaller outlet matches the cam timing of most modern high output engines.

Preferably, the core entrance area of inlet portion 164 is about 1.5 times the outlet area at outlet aperture 124, as shown (at least embodying herein wherein at least one third portion of such at least one exhaust gas transfer passage, adjacent the at least one exhaust gas outlet, comprises at least one third cross-sectional area no more than substantially equal to such at least one inlet cross-sectional area of the at least one exhaust gas inlet and wherein at least one fifth portion of such at least one exhaust gas transfer passage, situate between such at least one third portion and the at least one exhaust gas outlet, comprises at least one fifth cross-sectional area no more than substantially equal to such at least one outlet cross-sectional area of the at least one exhaust gas outlet). Preferably, the ratio of inlet to outlet areas can be tuned to suit different engine performance requirements. Preferably, the cross sectional area of chamber 168 (at least embodying herein such at least one second portion comprises at least one gas expansion chamber adapted to permit expansion of the at least one pressure wave during the transfer by such at least one exhaust gas transfer passage) is about 1.7 times the core entrance area of inlet portion 164, as shown.

Figure 19:
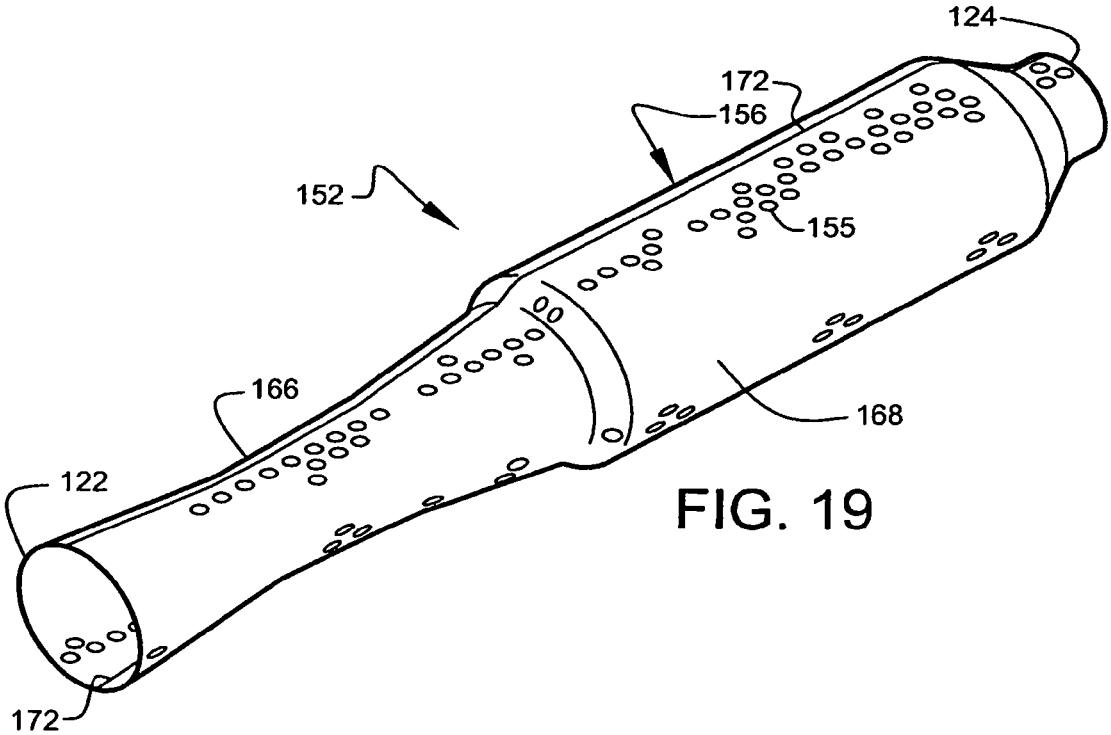
FIG. 19 shows a perspective view, illustrating a preferred perforated construction of the chambered core, according to the embodiment of FIG. 14.

FIG. 19 shows a perspective view, illustrating a preferred perforated construction of chambered core 152, according to the embodiment of FIG. 14. Preferably, chambered core 152 (at least embodying herein at least one exhaust gas transfer passage adapted to transfer the at least one moving exhaust gas between the at least one exhaust gas inlet and the at least one exhaust gas outlet) is constructed from two stamp-formed sheets of complementary shape, as shown. Preferably, each side of chambered core 152 comprises a longitudinal seam 172 that is welded for durability, as shown. Preferably, chambered core 152 is constructed from at least one heat resistive, non-corroding material. Preferably, chambered core 152 is formed from a perforated sheet metal (at least embodying herein wherein such at least one exhaust gas transfer passage further comprises at least one energy dissipater adapted to dissipate energy from the at least one pressure wave as the at least one moving exhaust gas is transferred by such at least one exhaust gas transfer passage). Preferred performance is achieved using a range of perforation sizes and spacing. Criteria used in selecting preferred perforation size and spacing includes the type of attenuating material 162 used (that is, apertures must be small enough to prevent passage of attenuating material 162 from interstitial space 160), and area of gas transfer required between chambered core 152 and interstitial space 160 (defining both aperture size and spacing and generally based on sound absorption requirements). As an example, chambered core 152 is preferably constructed from stainless steel sheet having a thickness of about 0.035", and a pattern of perforation holes having a diameter of about 0.117" on a stagger of about 0.156". In a second preferred example, as preferably used within certain high performance vehicle applications, chambered core 152 comprises a 30-mesh 304 stainless steel sheet comprising apertures having a diameter of about 0.0085". In other preferred embodiments, chambered core 152 comprises a perforated titanium material. Upon reading this specification, those of ordinary skill in the art will understand that, under appropriate circumstances, considering such issues as operator preference, sound attenuation requirements, intended vehicle application, etc., other core materials and perforation patterns, such as, for example, the use of larger or smaller diameter holes on a larger or smaller stagger, the use of mild steel, metallic alloys of aluminum, ceramics, etc., may suffice.

Figure 20:
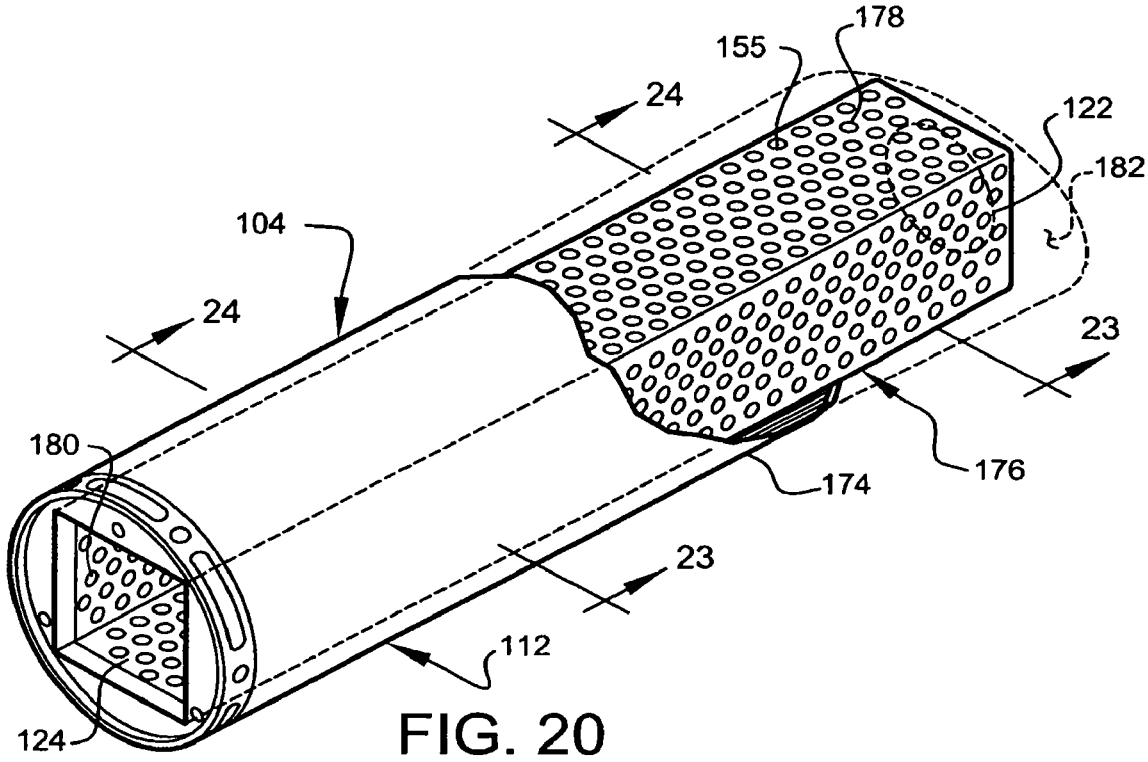
FIG. 20 shows a partial cut-away perspective view, of a muffler system comprising a planar wall core, according to another preferred embodiment of the present invention.

FIG. 20 shows a partial cut-away perspective view, of muffler system 104 comprising a single planar wall core 176, according to another preferred embodiment of the present invention (at least embodying herein a single exhaust gas transfer passage adapted to transfer the at least one moving exhaust gas between the at least one exhaust gas inlet and the at least one exhaust gas outlet).

Planar wall core 176 comprises an additional preferred embodiment of several preferred internal embodiments of muffler system 104. Preferably, planar wall core 176 functions to efficiently transfer a flow of exhaust gas from inlet aperture 122 to outlet aperture 124, by means of a uniquely shaped polygonal core having an enlarged core area, as shown.

Planar wall core 176 is typically situated within outer casing 174, as shown. Preferably, outer casing 174 comprises a structure matching the specialized housings of muffler system 104 described in FIG. 1 through FIG. 13, as shown. Upon reading this specification, those of ordinary skill in the art will understand that, under appropriate circumstances, such as user preference, advances in technology, intended vehicle application, etc., other outer canister shapes, such as round, oval, square, etc., used in combination with the planar core arrangement, may suffice.

Preferably, planar wall core 176 comprises an elongated tube having a plurality of planar walls, as shown. Preferably, planar wall core 176 comprises an arrangement of four planar walls generally forming a four sided polygon, most preferably comprising a square-shape in cross-section, as shown (at least embodying herein wherein such single exhaust gas transfer passage comprises a regular polygonal cross section and wherein such regular polygonal cross section comprises a square). Those skilled in the art, upon reading the teachings of this specification, will appreciate that, under appropriate circumstances, considering such issues as vehicle application and specific engine operational parameters, other multi-planar core shapes, such as pentagons, hexagons, heptagons, etc., may suffice. Preferably, the position of planar wall core 176 within outer casing 174 is firmly secured by end-caps 149, using, for example, integrally formed flanges, as shown.

Figure 21:
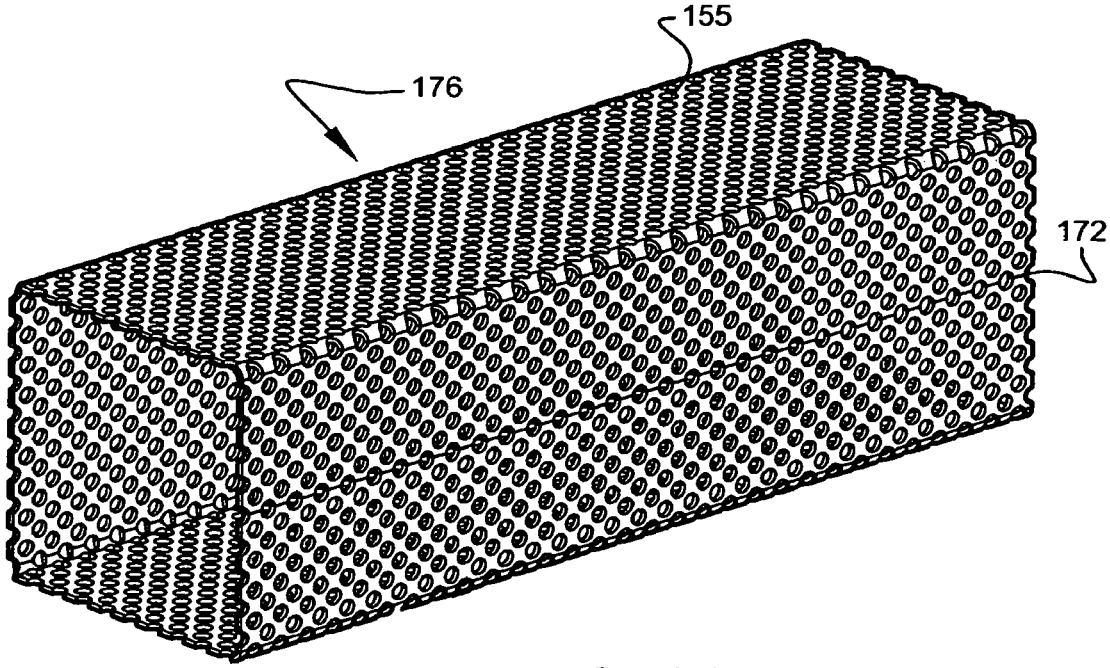
FIG. 21 shows a partial perspective view of the planar wall core of FIG. 20.

FIG. 21 is a partial perspective view, of the planar wall core 176 of FIG. 20. Preferably, planar wall core 176 is formed from a single substantially rectangular sheet of material, as shown. Preferably, planar wall core 176 is folded, by brake-forming or similar well-known means, to shape a single tubular conduit, as shown. Preferably, planar wall core 176 comprises a single longitudinal seam 172 that is welded for durability, as shown. Upon reading this specification, those of ordinary skill in the art will understand that, under appropriate circumstances, such as intended use, advances in technology, cost, etc., other means of forming a permanent seam, such as folded interlocking, bonding, mechanical fastening, fusing, cohering, etc., may suffice. Preferably, planar wall core 176 comprises a plurality of perforations 155, as shown (at least embodying herein wherein such at least one exhaust gas transfer passage comprises at least one energy dissipater adapted to dissipate energy from the at least one pressure wave while the at least one moving exhaust gas is transferred by such at least one exhaust gas transfer passage and wherein such at least one energy dissipater comprises at least one gas permeable aperture within such at least one exhaust gas transfer passage). Preferably, planar wall core 176 is constructed from at least one heat resistive, non-corroding material. Preferably, planar wall core 176 is constructed from stainless steel comprising a pattern of perforation holes having a diameter of about 0.117" on a stagger of about 0.156", as shown. Upon reading this specification, those of ordinary skill in the art will understand that, under appropriate circumstances, considering such issues as operator preference, sound attenuation requirements, intended vehicle application, etc., other materials and perforation patterns, such as, for example, the use of larger or smaller diameter holes on a larger or smaller stagger, the use of titanium or mild steel for the core, etc., may suffice. Preferably, planar wall core 176 comprises a "straight through" core design permitting at least one unrestricted linear passage of exhaust gas, as shown.

Figure 22:
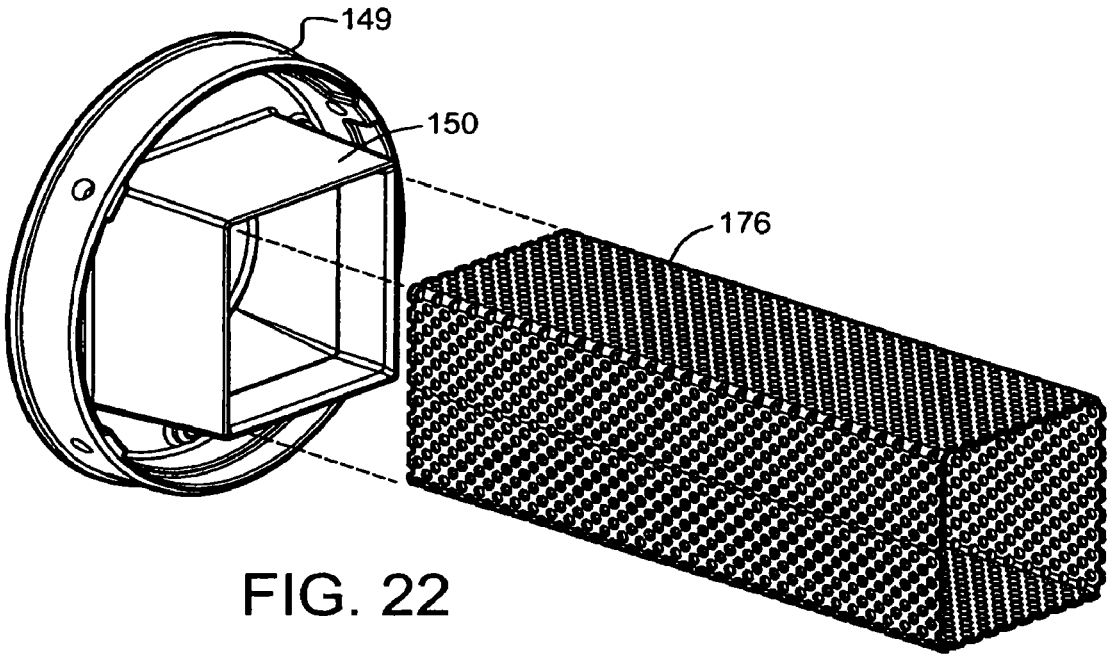
FIG. 22 shows a perspective view of an end receiver adapted to receive the planar wall core of FIG. 20.

FIG. 22 shows a perspective view of end receiver 149 adapted to receive planar wall core 176 of FIG. 20. Preferably, planar wall core 176 is secured to the interior of muffler system 104 by engaging a square receiver 150 on the bulkhead of end-cap 149, as shown. Upon reading the teachings of this specification, those of ordinary skill in the art will now understand that, under appropriate circumstances, considering such issues as user preference, intended use, etc., other methods of securing the core, such as directly welding to the end cap, providing brackets extending from the outer housing, etc., may suffice.

Figure 23:
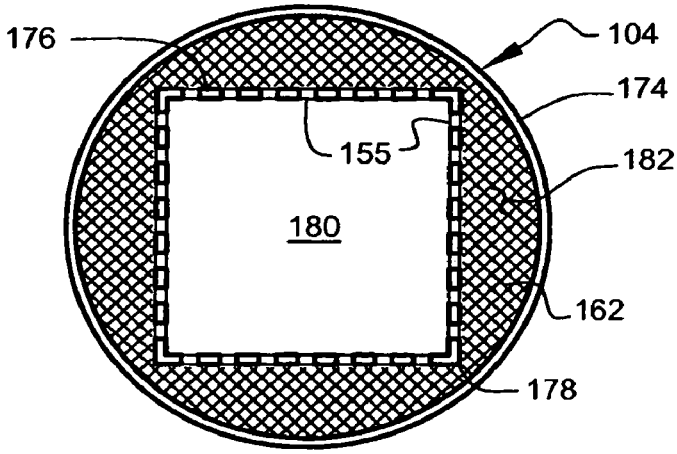
FIG. 23 shows a sectional view through the section 23-23 of FIG. 20, illustrating the internal arrangements of the muffler system of FIG. 20.

FIG. 23 shows a sectional view through the section 23-23 of FIG. 20 illustrating the internal arrangements of muffler system 104 of FIG. 20. Preferably, planar wall core 176 is centrally positioned within interstitial space 182 of outer casing 174, as shown. Preferably, perforations 155 of core wall 178 permits communication of exhaust gases between interior portion 180 and interstitial space 182 located between planar wall core 176 and outer casing 174, as shown. Typically, interstitial space 182 is packed with a gas-permeable sound-attenuating material 162 such as steel wool, fiberglass or ceramic fiber or similar high temperature fibrous media, as shown. Preferably, interstitial space 182 comprises four contiguous areas, each comprising an essentially equal cross sectional area, as shown. It should be noted that, as in the prior core embodiments, effective sound modification can be achieved without the use of packing material.

Figure 24:
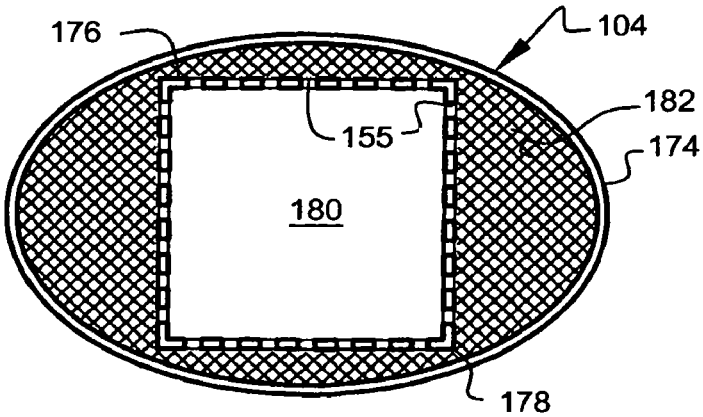
FIG. 24 shows a sectional view through the section 24-24 of FIG. 20 illustrating the internal arrangements of the muffler system of FIG. 20.

FIG. 24 shows a sectional view through the section 24-24 of FIG. 20 illustrating the internal arrangements of muffler system 104 of FIG. 20. FIG. 24 illustrates planar wall core 176 situated within the oval "inlet-side" portion of outer casing 174, as shown. Preferably, interstitial space 182 comprises two symmetrically opposing areas of moderately sized cross sectional areas, and two symmetrically opposing areas comprising relatively large cross sectional areas, as shown. Preferably, planar wall core 176 is configured to fit within outer casing 174 without contact, as shown. This non-contacting arrangement preferably permits outer casing 174 to comprise a relatively thin and lightweight composition, by thermally isolating core wall 178 from outer casing 174, as shown. Upon reading this specification, those of ordinary skill in the art will understand that, under appropriate circumstances, considering such issues as intended vehicle application, casing material selection, etc., other core/casing relationships, such as the use of a larger size core, continuously supported by a heat resistant casing, may suffice.

Figure 25:
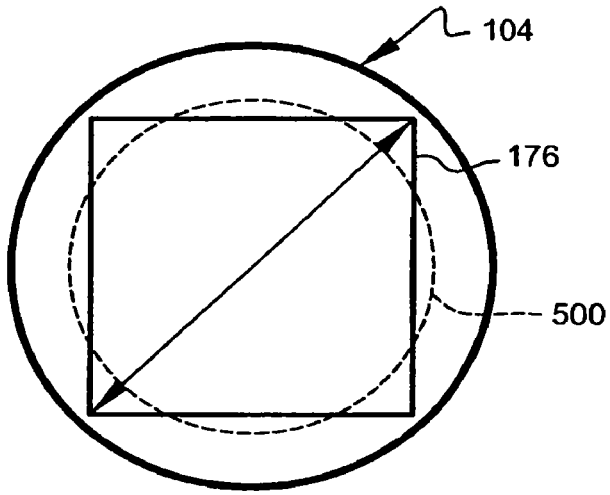
FIG. 25 shows a cross-sectional diagram, through the muffler system of FIG. 20, illustrating the dimensional relationships between a square planar wall core and a round core design, according to the preferred embodiment of FIG. 20.

FIG. 25 shows a cross-sectional diagram, through muffler system 104 of FIG. 20, illustrating the dimensional relationships between planar wall core 176 and conventional round core design 500, according to the preferred embodiment of FIG. 20. Preferably, planar wall core 176 effectively utilizes a characteristic inherent in all regular polygons, that is, for any given regular polygon, the aggregate perimeter length of the polygon is always greater than the circumference of a circle having an equal cross-sectional area. In practical application, the regular polygonal shape of planar wall core 176 permits a maximum cross-sectional area (at least embodying herein wherein such at least one regular polygonal cross-section comprises at least one cross-sectional area larger than such at least one inlet cross-sectional area) to maximize exhaust gas flow, combined with maximum interior surface area within planar wall core 176 (thereby maximizing potential exhaust gas flow interaction with any sound attenuating material contained within interstitial space 182, as shown. Additionally, planar wall core 176 (at least embodying herein wherein such single exhaust gas transfer passage comprises a regular polygonal cross section) will always comprise at least one internal linear dimension greater than that of the circle of equal cross-sectional area, as shown. Preferably, in application, planar wall core 176 functions to contemporaneously increase exhaust gas flow and decrease sound levels normally associated with hi-flow-capacity performance mufflers.

Preferably, the preferred polygon for use with planar wall core 176 is a square, as shown. As previously stated, those skilled in the art, upon reading the teachings of this specification, will appreciate that, under appropriate circumstances, considering such issues as vehicle application and specific engine operational parameters, other multi-planar core shapes, such as regular or irregular pentagons, hexagons, heptagons, etc., may suffice. The applicant has observed significant performance increases resulting from the use of the present embodiment using both square and rectangular sections. When compared to OE mufflers, muffler system 104, in combination with planar wall core 176, generally permits an improved throttle response and measurably increased torque at key points within the engine's power-band.

Figure 26:
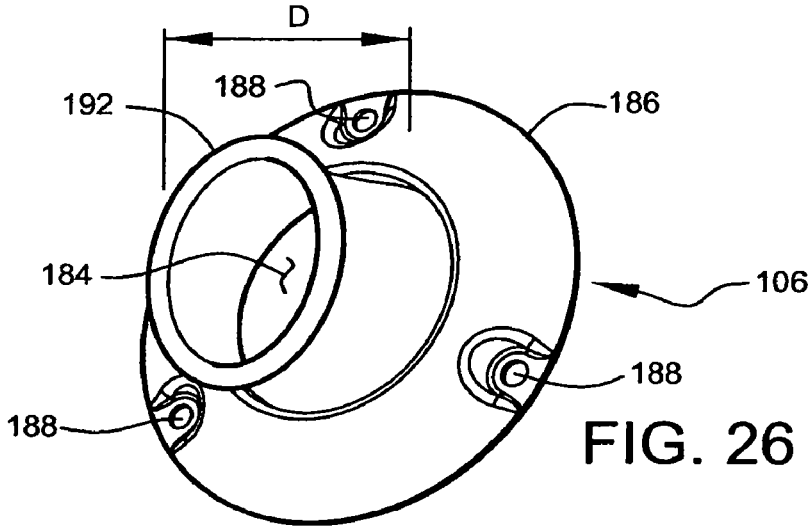
FIG. 26 shows a perspective view, illustrating a muffler system modular end-cap, according to a preferred embodiment of the present invention.

FIG. 26 shows a perspective view, illustrating modular end-cap 106, for use with exhaust system 100, according to a preferred embodiment of the present invention. Preferably, exhaust system 100 has been further refined by developing modular end-cap 106 to permit simple and efficient system tuning. Preferably, modular end-cap 106 comprises a one-piece, substantially disk-shaped body 186 having at least one exhaust outlet aperture 184, as shown. Preferably, exhaust outlet aperture 184 comprises a flow-directing extension 192 having an average projection length D, as shown. Preferably, flow-directing extension 192 directs the discharge of exhaust gasses exiting the muffler in a controlled manner, as shown. Preferably, flow-directing extension 192 projects generally outwardly from disk-shaped body 186, as shown. Preferably, modular end-cap 106 further comprises three mounting apertures 188 adapted to permit passage of mounting fasteners 190 (see FIG. 27).

Preferably, exhaust system 100 is tunable to the performance requirements of specific vehicle applications using the interchangeability feature of modular end-cap 106, as shown. Preferably, modular end-cap 106 enables the vehicle operator (or engine tuner), to quickly modify the flow/sound dynamics of exhaust system 100, by interchanging modular end-caps 106 of differing sized aperture outlets 184, as shown. This preferred feature permits muffler system 104 to comprise a fixed outlet aperture dimension that, for the present disclosure, may be defined as radius R. Preferably, modular end-cap 106 comprises three interchangeable variations, each variation comprising a specifically sized outlet aperture 184 (or insert). Additionally, modular end-cap 106 is adapted to house a spark-arresting feature to permit forest-legal vehicle operation. Upon reading this specification those of ordinary skill in the art will understand that under appropriate circumstances, considering such issues as user preference, advances in technology, intended application, etc., other end-cap configurations, such as the use of a single size end-cap in combination with apertured inserts, etc., may suffice.

Preferably, modular end-cap 106 comprises a high gas-flow variant having an outlet diameter of about 2", as shown. A second, modular end-cap 106 preferably comprises an outlet diameter of about 1¾". For applications requiring sound attenuation and/or a controlled power-band for increased ground-to-tire traction, a third variant comprising an outlet diameter of about 1½" is provided. Preferably, the operator/tuner selects the appropriate modular end-cap 106 to tailor the vehicle's performance to a specific sound emission or power-band requirement.

Figure 27:
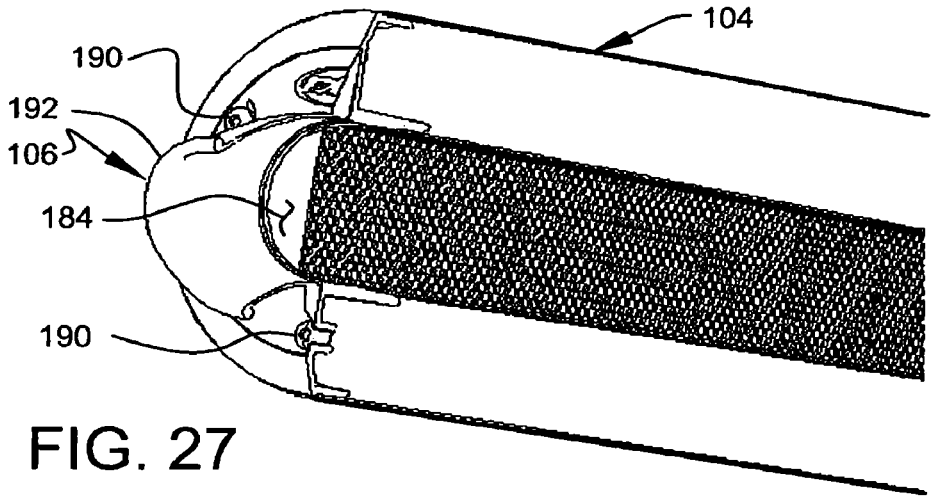
FIG. 27 shows a perspective view, partially in section, of the modular end-cap of FIG. 26.

FIG. 27 shows a perspective view, partially in section, of the modular end-cap of FIG. 26. Preferably, modular end-cap 106 is removably retained to muffler system 104 using three mounting fasteners 190, as shown. Preferably, mounting fastener 190 comprises a threaded screw or bolt, as shown.

Preferably, modular end-cap 106 is constructed of titanium, as shown. To assist a user in identifying modular end-cap 106, a specific blue anodized finish is applied, as shown. Upon reading this specification, those of ordinary skill in the art will understand that, under appropriate circumstances, in consideration of such issues as user preference, advances in technology, intended market, etc., other materials, such as titanium, alloys, polymers, ceramics, composites, etc., may suffice.

The especially short projection length D of flow-directing extension 192 significantly reduces material weight and exhaust system projection from the vehicle, thereby improving overall vehicle performance. Preferably, flow-directing extension 192 comprises an average length D no more that about radius dimension R, as shown (at least embodying herein wherein such average distance D is no more than about R).

Figure 28:
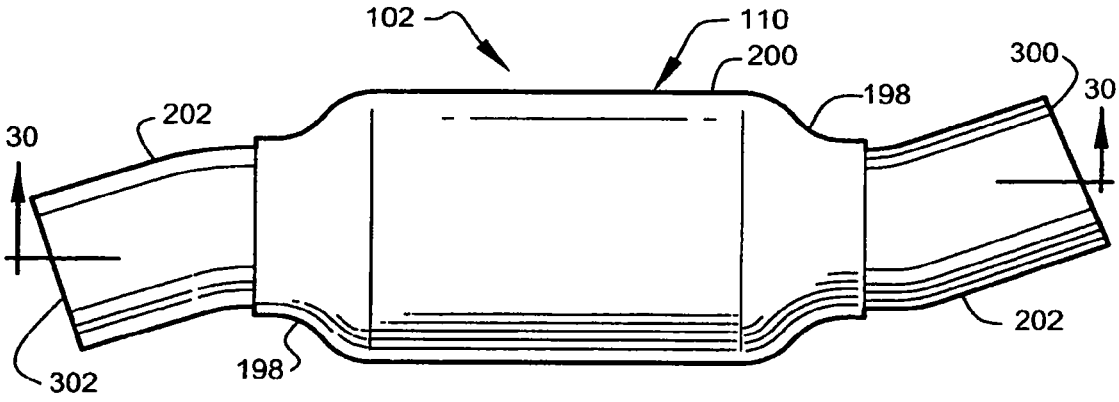
FIG. 28 shows a side view illustrating a power chamber system according to a preferred embodiment of the present invention.

FIG. 28 shows a side view illustrating power chamber 110 according to a preferred embodiment of the present invention. Preferably, power chamber 110 comprises a specialized adaptation within exhaust header system 102, (see FIG. 2). Preferably, power chamber 110 is specifically adapted to beneficially modify the flow dynamics of exhaust gases transported through header system 102. Preferably, power chamber 110 is integrally joined to header system 102, by welding, or similar well-known means, as shown.

Figure 29:
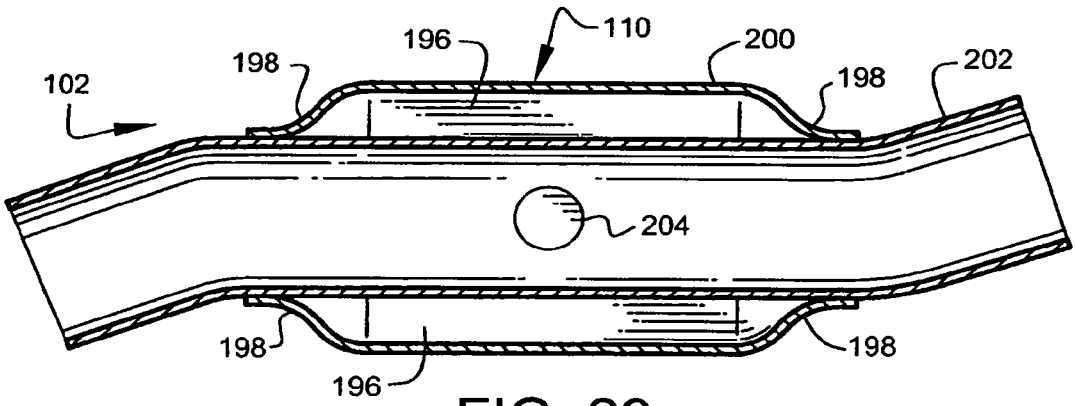
FIG. 29 shows a sectional view through a planar section bisecting the primary longitudinal axis of the power chamber system of FIG. 28.
Figure 30:
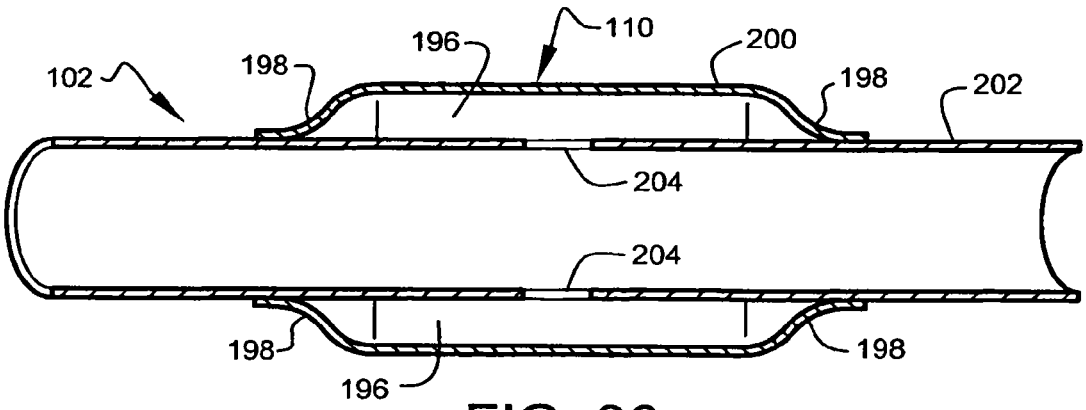
FIG. 30 shows a sectional view through the section 30-30 of FIG. 28.

FIG. 29 is a sectional view through a planar section bisecting the primary longitudinal axis of the power chamber 110 according to FIG. 28. FIG. 30 is a sectional view through the section 30-30 of FIG. 28. Referring to both FIG. 29 and FIG. 30, preferably, exterior chamber 200 of power chamber 110 comprises a hollow, essentially cylindrical shell, defining annular chamber 196, as shown (at least embodying herein at least one collection chamber, having length L, for collecting at least one portion of the at least one pressure wave). Preferably, annular chamber 196 surrounds a continuous length of header pipe 202 having an inlet side 300 (at least embodying herein at least one fluid inlet to admit the at least one moving fluid) and an outlet side 302 (at least embodying herein at least one fluid outlet to discharge the at least one moving fluid), as shown. Preferably, exterior chamber 200 comprises generally conical-shaped end portions 198 to permit a pressure sealed connection with the exterior circumference of header pipe 202 (at least embodying herein at least one fluid transfer conduit adapted to transfer the at least one moving fluid from such at least one fluid inlet to such at least one fluid outlet), preferably by continuous welding. Preferably, header pipe 202 comprises two apertures 204, preferably located at opposite sides of header pipe 202, as shown. Preferably, both apertures 204 are centrally located within exterior chamber 200 to permit fluid communication between interior portion 206 of header pipe 202 and annular chamber 196, as shown (at least embodying herein at least one energy dissipater adapted to dissipate energy from the at least one pressure wave during such transfer of the at least one moving fluid by such at least one fluid transfer conduit). Preferably, each aperture 204 (at least embodying herein at least one aperture adapted to pass the at least one portion of the at least one pressure wave from such at least one fluid transfer conduit to such at least one collection chamber) comprises a diameter of about 0.5". Preferably, the physical configuration of power chamber 110 is matched to the operational characteristics of the vehicle to which power chamber 110 is adapted. For example, a model RM-Z250 off-road motorcycle produced by Suzuki Motor Corporation, comprising header system 102, having a header pipe 202 diameter of 1.5" and two apertures 204 of about 0.5" diameter, will preferably comprise an exterior chamber 200 comprising a diameter of about 2", and a chamber 200 length of about 3.5". Preferably, apertures 204 are changed in both size and placement depending on the vehicle application. Preferably, annular chamber 196 is not resonant at exhaust pulse frequencies. This arrangement of preferred dimensional ratios can be generally applied to most vehicle applications as follows: wherein a given chamber 200 comprises a length of about L, at least one of the apertures 204 will comprise an effective diameter of at least 5% of the dimensional length L.

In operation, power chamber 110 permits an increase in engine performance through the expansion and contraction of exhaust-sonics through the system. More specifically, power chamber 110 acts as a flow-enhancer by allowing smooth high speed exhaust gases pulses to travel through the system at full velocity, while unsteady exhaust flow is corrected by the additional chamber area available for the rapidly expanding exhaust gases. Preferably, the exhaust pulse enters power chamber 110, where it expands and then cools to permit at least a portion of the exhaust gas to contract. This expansion and contraction effect functions to accelerate the exhaust pulse through the header. In some circumstances, the resulting acceleration may produce a scavenging effect on the exhaust port, permitting a larger charge of air and fuel to enter the cylinder for a more efficient burn.

Additionally, power chamber 110 is adapted to attenuate reflected gas pressure forces approaching the cylinder thereby reducing the tendency of the returning pressure waves to "back up" and hinder volumetric efficiency of subsequent incoming cycles. As exhaust pressure waves hit restrictive points within the exhaust path, a rebound pressure wave is generated back through the exhaust system. Preferably, power chamber 110 is adapted to provide the exhaust pressure wave with an additional area of expansion at a critical point within exhaust system 100. Preferably, power chamber 110 is adapted to "bleed off" pressure as it backs up in the exhaust system 100.

Testing has demonstrated measurable gas-flow increases, through a header system containing power chamber 110, of nearly ten percent. Furthermore, exhaust gas sound emissions from the header system containing power chamber 110 are effectively reduced.

Preferably, exterior chamber 200 is constructed from a material substantially similar in composition and weight to header pipe 202. Preferably, power chamber 110, header pipe 202 and (as applicable) mid pipe 108 are constructed from Grade 2 U.S.A. titanium. Preferably, header pipe 202 and (as applicable) mid-pipe 108 are CNC (computer numerical control) bent and TIG (Tungsten Inert Gas) welded. Upon reading this specification, those of ordinary skill in the art will understand that, under appropriate circumstances, such as user preference, advances in technology, intended market, etc., the use of other materials, such as stainless steel, mild steel, high-temperature alloys, etc., may suffice. Under appropriate circumstances, depending on the vehicle application, header pipe 202 may comprise differing diameters on entering and exiting power chamber 110.

Figure 31:
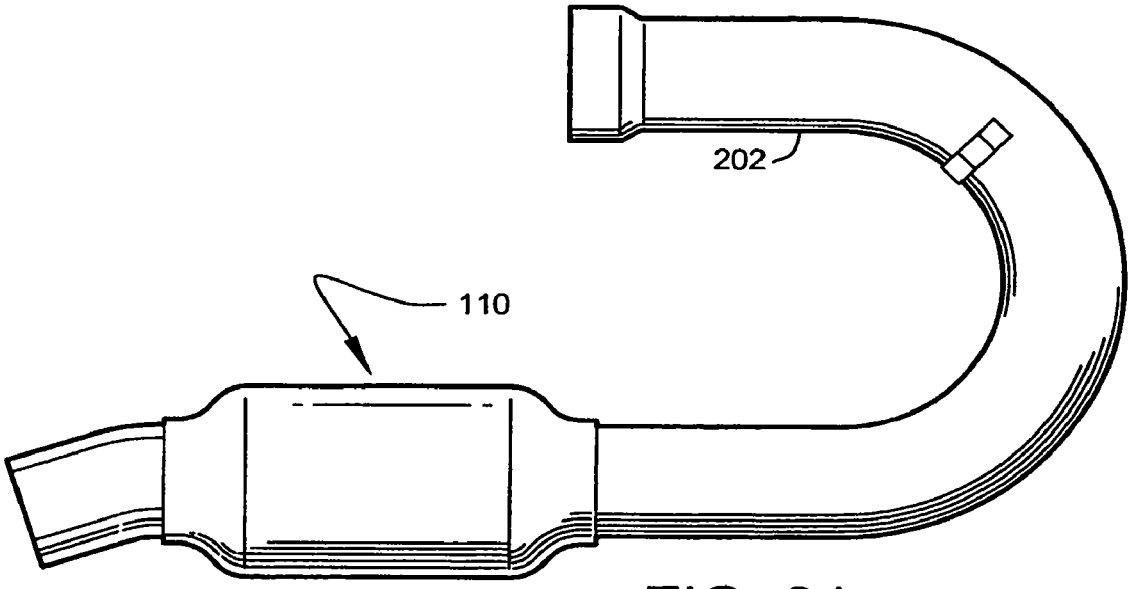
FIG. 31 shows a perspective view further illustrating typical arrangements of the power chamber system according to the preferred embodiment of FIG. 28.

FIG. 31 is a perspective view further illustrating typical arrangements of power chamber 110 according to the preferred embodiment of FIG. 28. Preferably, power chamber 110 comprises exhaust header pipe 202 adapted to couple to the exhaust port of an internal combustion engine (see FIG. 1). Preferably, header pipe 202 is adapted to fully replace the manufacturer's original exhaust header system, as shown. Preferably, header pipe 202 is designed to replace the OE exhaust header without significant modification, as shown. Exhaust header pipe 202 is preferably adapted to be mountable using all, or under appropriate circumstances a majority of, the OE support mountings, as shown. Upon reading this specification, those of ordinary skill in the art will understand that, under appropriate circumstances, such as vehicle operator preference, advances in exhaust technology, intended vehicle application, etc., other power chamber arrangements, such as, the use of larger or smaller apertures, larger or smaller annular chambers, shaped chambers, etc., may suffice.

Figure 33:
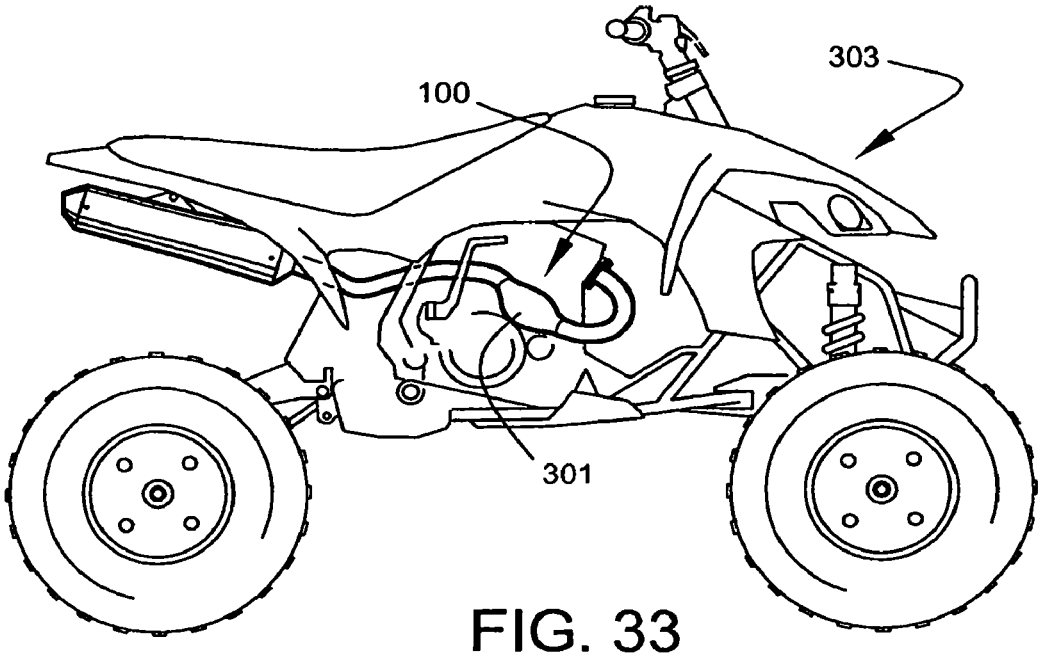
FIG. 33 shows a perspective view illustrating the power chamber installed within the exhaust system of a four-stroke internal combustion engine of an example vehicle according to the preferred embodiment of FIG. 32.
Figure 32:
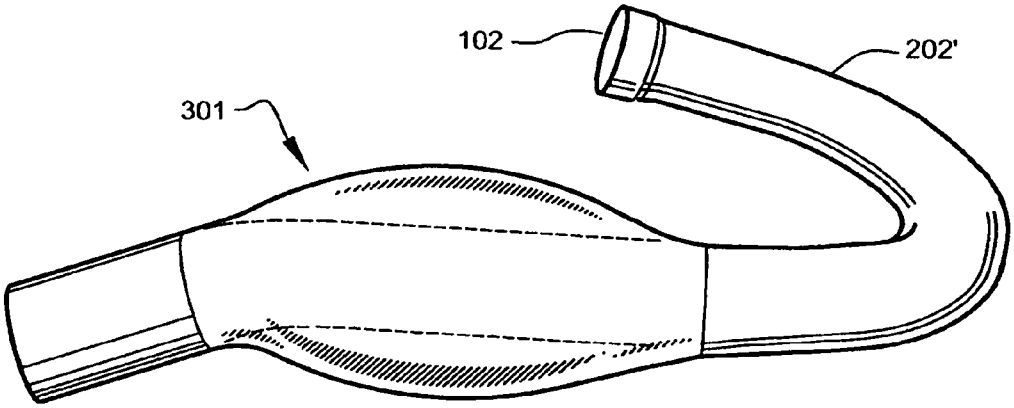
FIG. 32 shows a perspective view illustrating a second power chamber design according to another preferred embodiment of the present invention.

FIG. 32 is a perspective view illustrating power chamber 301 according to another preferred embodiment of the present invention. FIG. 33 is a perspective view illustrating power chamber 301 installed within exhaust system 100 of a four-stroke internal combustion engine of example vehicle 303 according to the preferred embodiment of FIG. 32. Referring now to both FIG. 32 and FIG. 33, power chamber 301 represents a further refinement to the power chamber design of FIG. 28 through FIG. 31. As in the prior power chamber embodiment, power chamber 301 is adapted to beneficially modify the flow dynamics of exhaust gases transported through exhaust system 100.

Although example vehicle 303 comprises a 450 cc Yamaha ATV (All Terrain Vehicle) model YZF 450, upon reading the teachings of this specification, those of ordinary skill in the art will now understand that, the use of the power chamber is not limited to the present "example" vehicle and may be readily adapted to many other vehicles, such as, alternate ATV makes/models, motorcycles, automobiles, watercraft, aircraft, etc. Preferably, power chamber 301 comprises exhaust header pipe 202' adapted to couple to the exhaust port of example vehicle 303, as shown. Preferably, exhaust header pipe 202' is adapted to fully replace the manufacturer's original exhaust header system, as shown. Preferably, exhaust header pipe 151' is designed to replace the OE exhaust header without significant modification, as shown. Exhaust header pipe 202' is preferably adapted to be mountable using all, or under appropriate circumstances a majority of, the OE support mountings, as shown.

Preferably, power chamber 301 is adapted to provide the exhaust pressure wave with an additional area of expansion at a critical point within exhaust system 100. Preferably, power chamber 301 is adapted to "bleed off" and reduce pressure as it backs up in the exhaust system 100. The exhaust "system" is considered, for the purpose of the present disclosure, to be the internal area between the exhaust valve and the outlet tip of the muffler. Pressure bleed off is understood to be a primary reason that power chamber 301 has consistently demonstrated a measurable increase in engine output after installation.

Typically, when a fuel mixture throttle of an internal combustion engine is opened quickly, a large volume of fuel/air is introduced to the piston cylinder, the mixture is combusted, and is expelled through the exhaust valve as a pressurized volume of exhaust gas. On passing the exhaust valve, the exhaust gas rushes through the exhaust tubes in a concentrated wave of pressure. As the pressure wave hits a restrictive point that prevents it from moving forward quickly or otherwise reduces its ability to flow freely, the exhaust gas generates a rebound pressure wave back through the exhaust system. This rebound or backpressure wave typically prevents a full and efficient evacuation of exhaust gases from the subsequent combustion cycles of the piston cylinder. As a result, this back up of pressure causes the engine to lose power, since the volumetric efficiency of the engine is now reduced. Typically, but not always, the beginning of the exhaust outlet tip is the smallest area within the exhaust system. Typically, this restriction at the exit of the exhaust system represents the largest restriction and is therefore a primary cause of rebounding pressure waves within the exhaust system.

Preferably, power chamber 301 provides, within exhaust system 100, a physical structure adapted to provide pressure relief from the backed up exhaust gas waves. This preferred arrangement permits an attenuation of returning gas pressure forces approaching the cylinder thereby reducing the tendency of the returning pressure waves to "back up" and hinder volumetric efficiency of subsequent incoming cycles.

Figure 34:
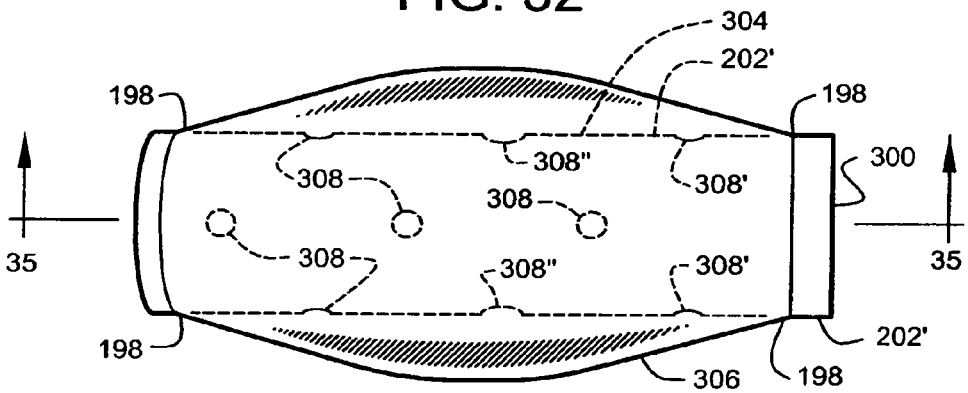
FIG. 34 shows a top view illustrating the power chamber according to the preferred embodiment of FIG. 32.

FIG. 34 shows a top view illustrating power chamber 301 according to the preferred embodiment of FIG. 33. The pressure relief effectiveness of power chamber 301 is principally the result of two design factors, an adequate gas transfer area between header pipe 202' and pressure-relieving annular chamber 306, in combination with an adequate internal volume within pressure-relieving annular chamber 306, as shown.

Preferably, pressure-relieving annular chamber 306 of power chamber 301 comprises a hollow shell, having a generally arcuate or bow-shaped solid outer surface, as shown (at least embodying herein at least one collection chamber for collecting at least one portion of the at least one pressure wave and at least embodying herein a second fluid-impervious-boundary-surface). Preferably, pressure-relieving annular chamber 306 surrounds a continuous length of header pipe 202' having an inlet side 300 (at least embodying herein at least one fluid inlet to admit the at least one moving fluid) and an outlet side 302 (at least embodying herein at least one fluid outlet to discharge the at least one moving fluid), as shown. Preferably, pressure-relieving annular chamber 306 comprises smoothly transitioning end portions 198 to permit a pressure sealed connection with the exterior circumference of center tube 304, preferably by continuous welding.

Figure 35:
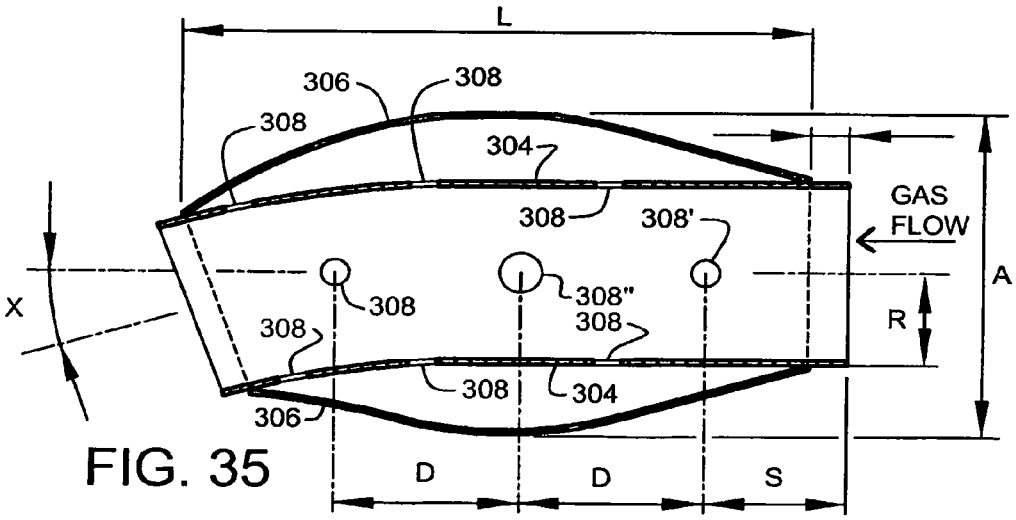
FIG. 35 shows a sectional view through the section 35-35 of FIG. 34 illustrating the internal arrangements of the power chamber according to the preferred embodiment of FIG. 32.

FIG. 35 shows a sectional view through the section 35-35 of FIG. 34 illustrating the internal arrangements of power chamber 301 according to the preferred embodiment of FIG. 33. Within this disclosure, the length "L" of header pipe 202 located within pressure-relieving annular chamber 306 is further identified as center tube 304 (at least embodying herein wherein at least one portion of such first fluid-impervious-boundary-surface is situate within such at least one collection chamber). Preferably, center tube 304 (at least embodying herein at least one fluid transfer conduit, comprising a first fluid-impervious-boundary-surface, adapted to transfer the at least one moving fluid from such at least one fluid inlet to such at least one fluid outlet) comprises a plurality of transfer apertures 308, preferably evenly dispersed along center tube 304, as shown. Preferably, transfer apertures 308 are located within pressure-relieving annular chamber 306 to permit fluid communication between interior portion 310 of center tube 304 and pressure-relieving annular chamber 306, as shown (at least embodying herein at least one energy dissipater adapted to dissipate energy from the at least one pressure wave during such transfer of the at least one moving fluid by such at least one fluid transfer conduit). Preferably, the combined area of all transfer apertures 308 (at least embodying herein at least one aperture adapted to pass the at least one portion of the at least one pressure wave from such at least one fluid transfer conduit to such at least one collection chamber) comprises an effective area not exceeding 15% of the external surface area (at least embodying herein wherein such at least one portion of such first fluid-impervious-boundary-surface comprises a boundary surface area) of the portion of center tube 304 situate within pressure-relieving annular chamber 306, as shown. This arrangement of preferred area ratios can be generally applied to most vehicle applications and is generally substantiated as effective through physical empirical testing.

Preferably, the physical configuration of power chamber 301 is matched to the operational characteristics of the vehicle to which power chamber 301 is adapted. For example, it was determined through dynamometer testing that a quantity of ten 0.250" holes and two 0.375" holes provided sufficient area to efficiently transfer the pressure within example vehicle 303 as well as other vehicle having engine displacements between 250 cc and 450 cc. Preferably, to provide balanced passage of exhaust gases between center tube 304 and annular chamber 306, transfer apertures 308 are preferably staggered and spaced such that the distance between each transfer aperture 308 is greater or at least about equal to the radius R of center tube 304.

Through physical testing, it was determined that the internal volume of pressure-relieving annular chamber 306 is also important to engine performance. Preferably, pressure-relieving annular chamber 306 is arranged to contain much of the returning gas pressure while maintaining a small enough structure to fit within the application vehicle. Preferably, (as demonstrated for example vehicle 303) pressure-relieving annular chamber 306 comprises an outer diameter A of about 3.0". Preferably, pressure-relieving annular chamber 306 comprises an overall length L of about 5.75". Preferably, center tube 304 comprises a radius R of about 0.875". Preferably, pressure-relieving annular chamber 306 transitions from the outer diameter of center tube 304 to dimension A along an essentially arcuate line approximately following a linear angle of about sixteen degrees, as shown (at least embodying herein wherein such at least one collection chamber comprises at least one second fluid-impervious-boundary-surface, and such at least one second fluid-impervious-boundary-surface is substantially arcuate in shape). A twenty degree flow transition X provides proper clearances within example vehicle 303 (other vehicle applications comprise embodiments having no transition). Preferably, transfer apertures 308 are located at spacing D equaling about 1.625", as shown. Preferably, a first pair of apertures 308' (relative to gas flow) are located a distance S of about 1 inch as measured from the leading edge of pressure-relieving annular chamber 306, as shown. Preferably, two apertures 308" comprise a diameter of about 0.375", as shown. Preferably, apertures 308 and aperture 308' comprise a diameter of about 0.25", as previously described.

It should be noted that the above-described configuration of power chamber 301 has been shown to be effective when applied to example vehicle 303, and to a wide range of alternate vehicles of various displacements.

Figure 36:
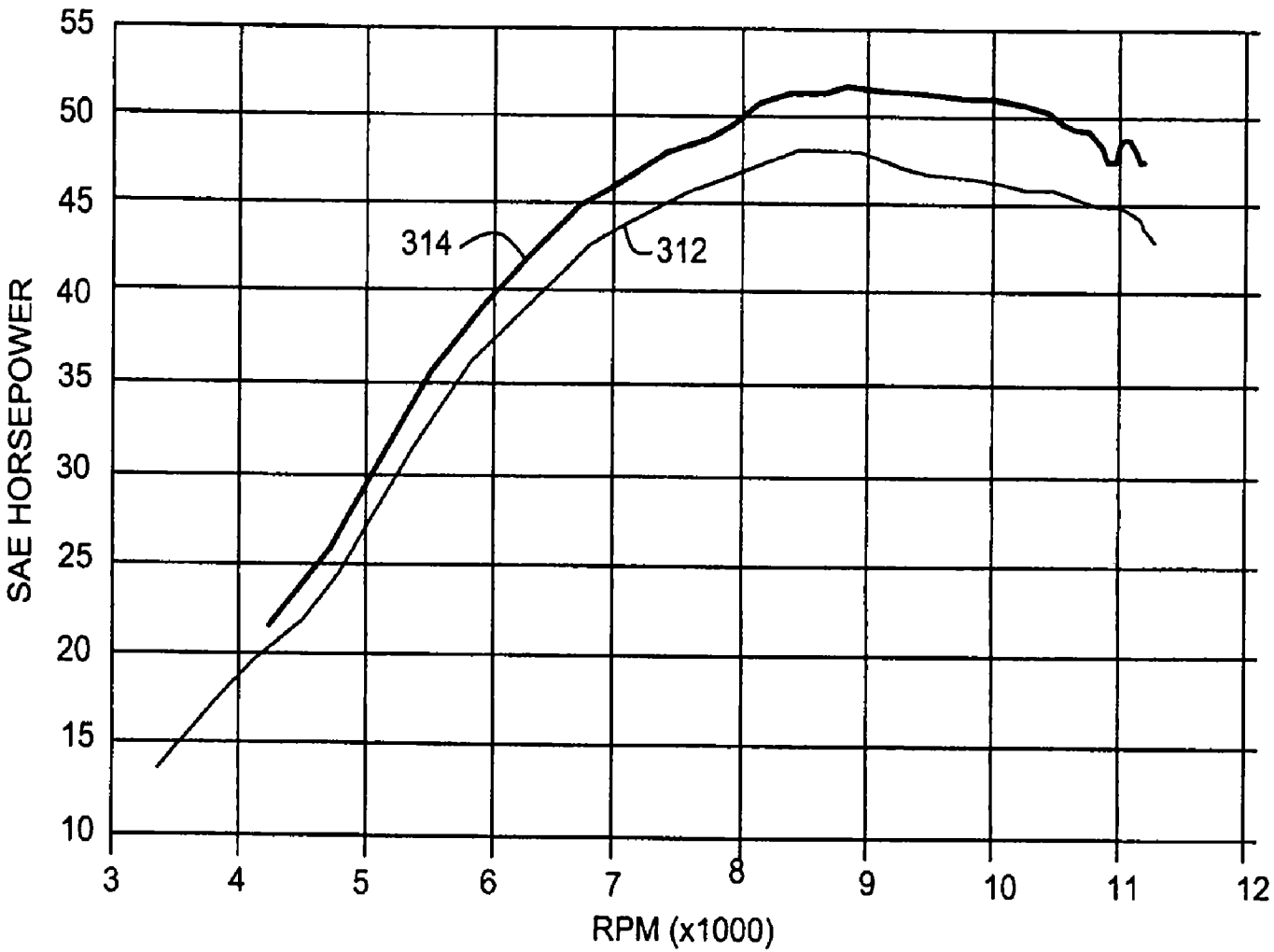
FIG. 36 shows a line graph illustrating dynamometer test results for the example vehicle in both stock configuration and utilizing the power chamber.

FIG. 36 is a line graph illustrating dynamometer test results for example vehicle 303 in both stock configuration and utilizing power chamber 300. Line 312 shows the SAE horsepower for example vehicle 303 in stock configurations. Line 312 establishes the stock performance baseline for example vehicle 303 across the engine's operational RPM range. In stock condition, example vehicle 303 produces a peak output of about 48 HP at about 8600 RPM. Line 314 shows the SAE horsepower for example vehicle 303 utilizing power chamber 301. In such modified condition, example vehicle 303 produces a peak output of over 51 HP at about 8800 RPM. It is anticipated that increased performance can be achieved with power chamber designs comprising an effective aperture transfer area up to about 15% of the external surface area of the portion of center tube 304 situate within pressure-relieving annular chamber 306.

In addition to power increases, power chamber 301 provides a measurable reduction in the decibel sound output from the vehicle exhaust. Beneficial pressure "bleed off" is understood to be the primary reason power chamber 301 provides decibel noise reduction. Since the noise exiting from the rear of the exhaust system is a wave of pressure, the less concentrated the pressure, the less sound or decibel amount will be produced by the exiting wave.

Preferably, power chamber 301 is adapted to provide a reduction of pressure reaching the exhaust tip in any given muffler configuration. Use of power chamber 301, in combination with conventional muffler arrangements, provides an enhanced sound reduction within essentially all muffler/silencer-containing system. Additionally, the use of power chamber 301 permits the use of small area exhaust tips to reduce sound, without the associated reduction in engine performance. Physical empirical testing of power chamber 301 demonstrates that small area exhaust tips may be utilized to reduce sound without losing significant amounts of torque in the lower RPM ranges.

Preferably, pressure-relieving annular chamber 306 is constructed from a material substantially similar in composition and weight to header pipe 202'. Preferably, pressure-relieving annular chamber 306, header pipe 202' and mid pipe (as applicable) are constructed from ASTM B 338 Grade 2 U.S.A. titanium having a thickness of about 0.035". Preferably, header pipe 202' (at least embodying herein a first fluid-impervious-boundary-surface) and the mid-pipe (as applicable) are CNC (computer numerical control) bent and TIG (Tungsten Inert Gas) welded. Upon reading this specification, those of ordinary skill in the art will understand that, under appropriate circumstances, such as user preference, advances in technology, intended market, etc., the use of other materials, such as stainless steel, mild steel, high-temperature alloys, etc., may suffice. Under appropriate circumstances, depending on the vehicle application, header pipe 202' may comprise differing diameters on entering and exiting power chamber 301.

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

The invention claimed is:

1. A vehicular muffler system, relating to modifying at least one pressure wave of at least one moving exhaust gas passing through at least one muffler housing, said system comprising:

the at least one muffler housing having at least one exhaust gas inlet to admit the at least one moving exhaust gas and at least one exhaust gas outlet to discharge the at least one moving exhaust gas;

at least one exhaust gas transfer passage adapted to transfer the at least one moving exhaust gas between the at least one exhaust gas inlet and the at least one exhaust gas outlet, wherein the at least one exhaust gas transfer passage includes core walls that are disposed within the at least one muffler housing between the at least one exhaust gas inlet and the at least one exhaust gas outlet;

a gas-permeable sound-attenuating material locating in an interstitial space created between the core walls and an interior of the at least one muffler housing, wherein the core walls include a plurality of perforations to permit fluid communication between an interior of the at least one exhaust gas transfer passage and the interstitial space, wherein the plurality of perforations is configured in a pattern of perforation holes that spans a entire surface area of the core walls and that is characterized by a hole diameter and a stagger of holes, wherein the hole diameter and the stagger of holes are configured based on a type of the gas-permeable sound-attenuating material located in and interstitial space and an area of gas transfer utilized to modify the at least one pressure wave of the at least one moving exhaust gas passing into the interior of the at least one exhaust gas transfer passage, wherein the hole diameter ranges from 0.12 inches to 0.008 inches, wherein the core walls of the at least one exhaust gas transfer passage are formed into distinct portions that permit at least one unrestricted linear passage of at least one portion of the at least one moving exhaust gas from the at least one exhaust gas inlet to the at least one exhaust gas outlet, the portions comprising:

(a) at least one first portion of said at least one exhaust gas transfer passage, adjacent the at least one exhaust gas inlet, that comprises at least one substantially uniform first cross-sectional area that is substantially equal to such at least one inlet cross-sectional area of the at least one exhaust gas inlet;

(b) at least one second portion of said at least one exhaust gas transfer passage, adjacent the at least one first portion, that initially provides a constriction with a reduced cross-sectional area that is substantially less than the inlet cross-sectional area and that accelerates a speed of the at least one moving exhaust gas, thereby reducing a pressure of the at least one moving exhaust gas on the gas-permeable sound-attenuating material via the plurality of perforations located at the at least one second portion, and that subsequently steps up to at least one second cross-sectional area substantially larger than such at least one first cross-sectional area;

(c) at least one third portion of said at least one exhaust gas transfer passage, adjacent to at least one second portion and to the at least one exhaust gas outlet, that initially comprises at least one third cross-sectional area no more than substantially equal to such at least one inlet cross-sectional area of the at least one exhaust gas inlet, that subsequently steps up to a chamber having a chamber cross-sectional area that is substantially 1.7 times larger than the first cross-sectional area, wherein the chamber cross-sectional area prevents pressure obstruction of the at least one moving exhaust gas and induces eddies thereof, and that steps down to a cross-sectional area of the at least one exhaust gas outlet, wherein the at least one inlet cross-sectional area of the least one exhaust gas inlet is substantially 1.5 times larger than the cross-sectional area of the at least one exhaust gas outlet.

2. The vehicular exhaust system according to claim 1 wherein said at least one exhaust gas transfer passage comprises at least one exhaust gas flow-accelerating portion.

3. The vehicular exhaust system according to claim 2 wherein said at least one exhaust gas flow-accelerating portion is accomplished per "Venturi"-type constriction.

4. The vehicular exhaust system according to claim 1 wherein said at least one exhaust gas transfer passage further comprises at least one energy dissipater adapted to dissipate energy from the at least one pressure wave as the at least one moving exhaust gas is transferred by said at least one exhaust gas transfer passage.

5. The vehicular exhaust system according to claim 1 wherein at least one portion of said at least one exhaust gas transfer passage comprises at least one regular polygonal cross-section.

6. The vehicular exhaust system according to claim 5 wherein said at least one regular polygonal cross-section comprises at least one square cross-section.

7. The vehicular exhaust system according to claim 5 wherein the pattern of perforation hole is configured with the hole diameter of substantially 0.117 and the stagger of holes of substantially 0.156 inches, thereby preventing the gas-permeable sound-attenuating material from transferring from the interstitial space to the interior of the at least one exhaust gas transfer passage.

8. The vehicular exhaust system according to claim 1 adapted to use with motorcycles.

9. The vehicular exhaust system according to claim 1 adapted to use with all-terrain vehicles.

10. The vehicular exhaust system according to claim 1 adapted to use with automobiles.

11. The vehicular exhaust system according to claim 1 adapted to use with personal watercraft.

12. The vehicular exhaust system according to claim 1 adapted to use with aircraft.

* * * * *